US006906695B1

(12) United States Patent
Ishida et al.

(10) Patent No.: US 6,906,695 B1
(45) Date of Patent: Jun. 14, 2005

(54) TOUCH CONTROL APPARATUS AND TOUCH CONTROL METHOD THAT CAN BE APPLIED TO ELECTRONIC INSTRUMENT

(75) Inventors: Tadayuki Ishida, Hamamatsu (JP); Hideyuki Tanaka, Fukuroi (JP); Kikuro Yamauchi, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 157 days.

(21) Appl. No.: 09/724,200

(22) Filed: Nov. 27, 2000

(30) Foreign Application Priority Data

Nov. 26, 1999 (JP) ..... 11-335769
Sep. 28, 2000 (JP) ..... 2000-296874

(51) Int. Cl.[7] ..... G09G 5/00

(52) U.S. Cl. ..... 345/156; 345/168; 345/172; 345/173; 178/18.02; 178/17 C; 200/314; 84/607; 84/608; 84/626; 341/23; 341/26

(58) Field of Search ..... 84/607, 608, 626; 178/17 C, 18.02; 200/314; 341/23, 26; 345/156, 168, 172, 173

(56) References Cited

U.S. PATENT DOCUMENTS 4,875,400 A * 10/1989 Okuda et al. ..... 84/626
4,954,823 A * 9/1990 Binstead ..... 341/26
5,308,917 A * 5/1994 Kitamura et al. ..... 84/607
5,350,880 A * 9/1994 Sato ..... 84/609
5,792,971 A * 8/1998 Timis et al. ..... 84/609
6,337,678 B1 * 1/2002 Fish ..... 345/156
6,424,338 B1 * 7/2002 Anderson ..... 178/18.01

FOREIGN PATENT DOCUMENTS

| | | |
|---|---|---|
| JP | 60-68385 | 4/1985 |
| JP | 4-60590 | 2/1992 |
| JP | 04-060590 | 2/1992 |
| JP | 2896948 | 6/1993 |
| JP | 06-167971 | 6/1994 |
| JP | 6-167971 | 6/1994 |
| JP | 11-38975 | 2/1999 |
| JP | 11-038975 | 2/1999 |

* cited by examiner

*Primary Examiner*—Xiao Wu
*Assistant Examiner*—Abbas Abdulselam
(74) *Attorney, Agent, or Firm*—Christie, Parker and Hale, LLP

(57) ABSTRACT

A touch curve memory 110 stores therein a touch curve formed by velocity values corresponding to touch data generated by a keyboard device 20. A correction coefficient generator 10 generates a correction coefficient composed of a ratio of one of the velocity values stored in the touch curve memory corresponding to one of the touch data generated by the keyboard device, in a maximum touch memory mode switched by a mode switch 21 (SW1), to a maximum value of the velocity values in the touch curve memory. A corrector 10 multiplies the correction coefficient generated by the correction coefficient generator by the respective velocity values stored in the touch curve memory, and then generates a touch curve formed by new velocity values. Accordingly, it is possible to provide a touch control apparatus and a touch control method which can obtain a touch curve, from which a touch response suitable for a user can be obtained, easily and in a short time.

23 Claims, 22 Drawing Sheets

EXAMPLE OF F(X) DEFINED AS THE CURVED LINE

TOUCH CONTROL APPARATUS AND TOUCH CONTROL METHOD THAT CAN BE APPLIED TO ELECTRONIC INSTRUMENT

BACKGROUND OF THE INVENTION

1. Field of the Invention

The present invention relates to a touch control apparatus and a touch control method that can be applied to an electronic instrument. More particularly, the present invention relates to a technique for obtaining a touch response optimal for a keying power of a user.

2. Description of the Related Art

Typically, a characteristic of the touch response in an electronic keyboard instrument, such as an electronic piano, is determined in accordance with a touch curve. The keyboard instrument, which can control the touch response, has in each key a first key switch S1 to be turned on by a first push depth and a second key switch S2 to be turned on by a second push depth deeper than the first push depth. Signals indicating an on state and an off state of the first key switch S1 and the second key switch S2 are supplied to a touch sensor. The touch sensor measures a time until the signal indicating that the second key switch S2 is turned on is inputted after the signal indicating that the first key switch S1 is turned on is inputted, and thereby detects a key push speed $\Delta t$ (=S2−S1). As shown in FIG. 1, this key push speed $\Delta t$ is converted into 128-stage digital data, and outputted as touch data.

The touch data outputted from this touch sensor is further converted in accordance with any of touch curves T1 to T3 shown in FIG. 2. Thus, a velocity value to be used for producing a tone is obtained. A user can select any one of the touch curves T1 to T3 to be used (this is referred to as "a function of selecting a touch curve"). By the way, the touch curve T1 is referred to as "Normal", and it is designed such that a sound, which is the nearest an acoustic piano, is generated when a person having a standard keying power operates a keyboard. The touch curve T2 is referred to as "Light", and it is used to obtain a large velocity value with a weak touch. This touch curve T2 is suitable for a person having a weaker keying power than a standard keying power, such as a low age group or a high age group. Also, the touch curve T3 is referred to as "Heavy", and it is used to obtain a small velocity value with a strong touch. This touch curve T3 is suitable for a person having a stronger keying power than the standard keying power.

Since a maker usually provides the touch curves T1 to T3, the user can not change them arbitrarily. Hence, a touch control apparatus that can attain a touch response coincident with a taste of the user is desired. Especially, even the person having a relatively weak keying power, such as the low age group and the high age group, has recently desired the play of a high level in which the strong and weak keying powers are used. This results in a problem that only the conventional function of selecting the touch curve can not correspond to a wider age group.

In order to solve above-mentioned problem, Japanese Laid Open Patent Application (JP-A-Showa, 60-68385) discloses "TOUCH RESPONSE APPARATUS" (hereafter, referred to as a first prior art). This touch response apparatus is designed such that a velocity value is entered manually for each of 32 kinds of push key velocities to thereby prepare touch curves and store in a memory. Then, at a time of a play, a velocity value corresponding to a key push speed is read out from the memory, and it is accordingly reflected in the play.

Also, Japanese Laid Open Patent Application (JPA-Heisei, 11-38975) discloses "APPARATUS FOR SETTING VELOCITY CURVE IN ELECTRONIC KEYBOARD INSTRUMENT" (hereafter, referred to as a second prior art). In this apparatus, the velocity values at the times of the weakest keying power and the strongest keying power are entered to thereby generate a velocity curve Moreover, Japanese Patent No. 2896948 discloses "APPARATUS FOR SETTING TOUCH RESPONSE FOR KEYBOARD" (hereafter, referred to as a third prior art). In this apparatus, each of a weak hit, a middle hit and a strong hit is performed a plurality of times to accordingly calculate the average of the velocity t, values for each hit. Then, they are linearly interpolated to thereby obtain a touch curve.

However, in the touch response apparatus according to the first prior art, many manual operations are required to prepare the touch curve. Thus, it takes a long time to obtain the desirable touch curve. Also, high music knowledge and experience are required to prepare the touch curve capable of obtaining the desirable touch response. This results in a problem that it is difficult to prepare the touch curve for a beginner.

In the apparatus according to the second prior art, it is necessary to enter the velocity values at the times of the weakest keying power and the strongest keying power. Thus, it takes a long time to prepare the touch curves. Also, the above-mentioned Japanese Patent No.2896948 does not disclose an input portion of the weakest value and an input portion of the strongest value in detail. However, from the descriptions in which the velocity value at the time of the weakest keying power is set to "10" (20 to 21 lines of a fourth column) and the velocity value at the time of the strongest keying power is set to "140" (30 to 31 lines of the fourth column), it may be understood that the input of the velocity value is done from an input device other than the keyboard device. Thus, since the input device is required, the configuration of the electronic instrument having the apparatus for setting a touch curve is complex and its cost is expensive.

In the apparatus according to the third prior art, it is necessary to enter the velocity values at the times of the weak hitting, the middle hitting and the strongest hitting. Thus, it takes a long time to prepare the touch curve. Moreover, at a time of the play, only the touch response based on the prepared touch curve is reproduced, which does not imply that the play of a user having a weak keying power can be simulated as if it is a play of a user having a standard keying power.

Moreover, the second and third prior arts require the touch data in the case of the keying powers through the different forces such as the weak, middle and strong keying powers. However, it is difficult that the beginners know what degree of keying power leads to the weak hitting, the middle hitting or the strong hitting. Thus, it is difficult to obtain the desirable touch curve.

Moreover, Japenese Laid Open Patent Application (JP-A-Heisei, 4-60590) discloses "ELECTRONIC MUSICAL INSTRUMENT". In this electronic musical instrument, touch data is automatically changed such that player can play by the desirable key touch.

Furthermore, Japanese Laid Open Patent Application (JP-A-Heisei, 6-167971) discloses "PERFORMANCE EQUIPMENT". This performance equipment, when the player plays a predetermined number note, calculates an average of the velocity, then automatically chooses a velocity change characteristic that is the optimal for a performance characteristic of the player based on this calculation result.

SUMMARY OF THE INVENTION

The present invention is accomplished in view of the above mentioned problems. Therefore, an object of the present invention is to provide a touch control apparatus and a touch control method that can prepare a touch curve, from which a touch response suitable for a user can be obtained, easily and in a short time.

A touch control apparatus according to a first aspect of the present invention includes a keyboard device, a touch curve memory and a corrector. The keyboard device generates touch data indicative of strength of keying power. The touch curve memory stores a touch curve indicative of a correspondence relation of velocity and touch data. The corrector corrects velocity values of the touch curve stored in the touch curve memory based on the touch data generated by the keyboard device to generate a new touch curve.

A touch control apparatus according to a second aspect of the present invention includes a keyboard device, a correction curve memory and a corrector. The keyboard device generates touch data indicative of strength of keying power. The correction curve memory stores a correction curve indicative of correction rL values to correct a keyboard curve indicative of a correspondence relation of velocity and touch data., in this case, the correction values correspond to the touch data generated by the keyboard device. The, corrector corrects the correction values stored in the correction curve memory based on the touch data generated by the keyboard device to generate a new correction curve.

A touch control method according to a third aspect of the present invention includes the steps of generating, storing and correcting. In the generating step, touch data indicative of strength of keying power is generated. In the storing step, a touch curve indicative of a correspondence relation of velocity and touch data is stored. In the correcting step, velocity values of the touch curve are corrected based on the generated touch data to generate a new touch curve.

A touch control method according to a fourth aspect of the present invention includes the steps of generating, storing and correcting. In the generating step, touch data indicative of strength of keying power is generated. In the storing step, a correction curve indicative of correction values to correct a keyboard curve indicative of a correspondence relation of velocity and touch data is stored. In this case, the correction values correspond to the touch data generated in the touch data generating step. In the correcting step, the stored correction values are corrected based on the generated touch data to generate a new correction curve.

DESCRIPTION OF THE PREFERRED EMBODIMENTS

A touch control apparatus and a touch control method according to embodiments of the present invention will be described below in detail with reference to the attached drawings. Hereafter, let us suppose that the touch control apparatus is assembled in an electronic instrument. So, in order to easily understanding the present invention, the whole configuration and operation of the electronic instrument will be described below. It should be noted that, in the respective embodiments, the same or, corresponding portions are given the same reference numbers, and the explanations are omitted or simplified.

(First Embodiment)

Figure 3:
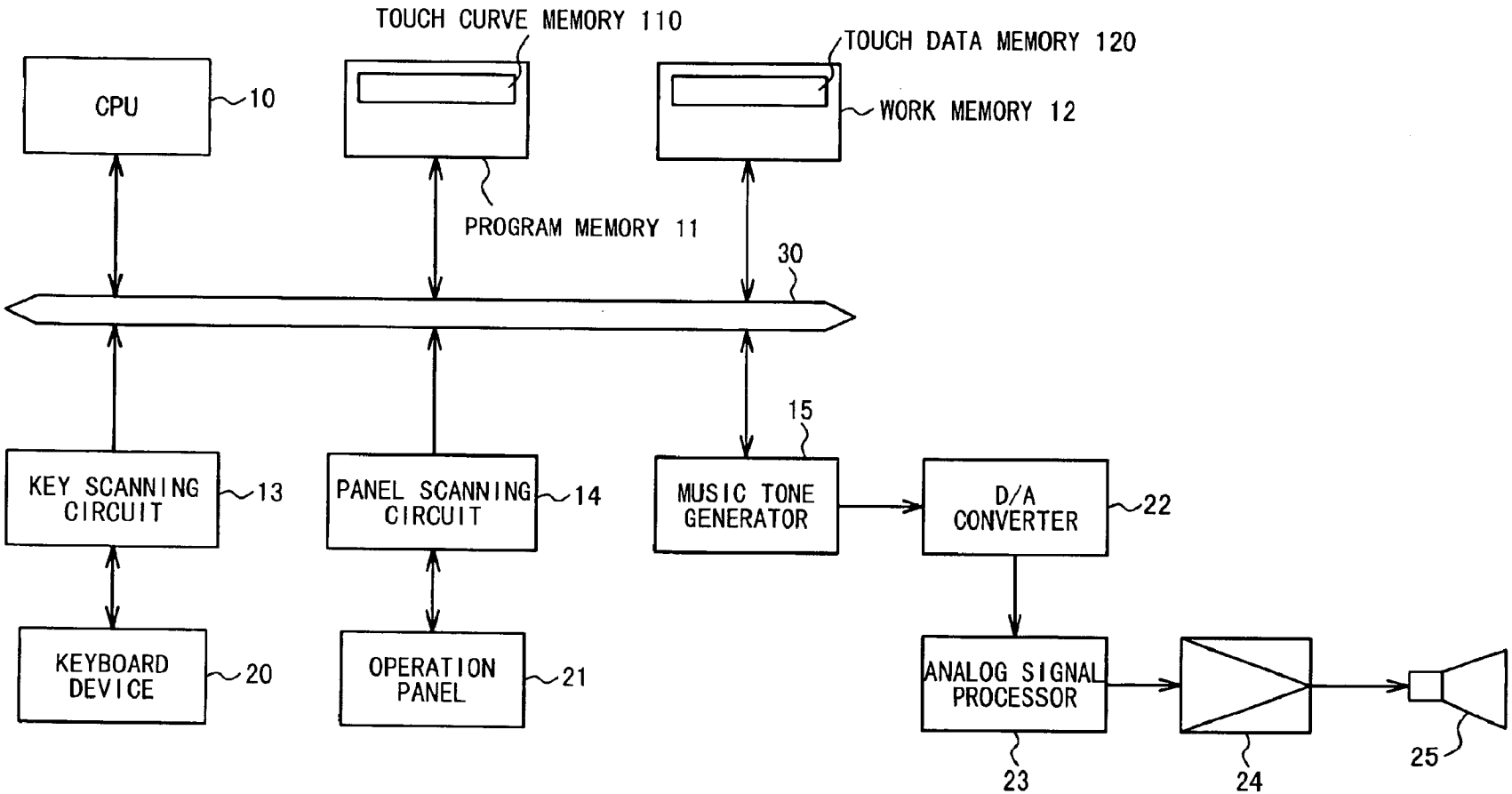
FIG. 3 is a block diagram showing a configuration of an electronic instrument to which a touch control apparatus according to a first embodiment of the present invention is applied.

FIG. 3 is a block diagram showing the configuration of an electronic instrument to which a touch control apparatus according to an embodiment of the present invention is applied. This electronic instrument is composed of a central processing unit (CPU) 10, a program memory 11, a work memory 12, a key scanning circuit 13, a panel scanning circuit 14 and a music tone generator 15 which are connected through a system bus 30 to each other. The system bus 30 sends and receives an address signal, a data signal or a control signal or the like.

The CPU 10 controls the whole electronic instrument, in accordance with a control program stored in the program memory 11. The content of the control by the CPU 10 will be described later with reference to flowcharts.

Figure 2:
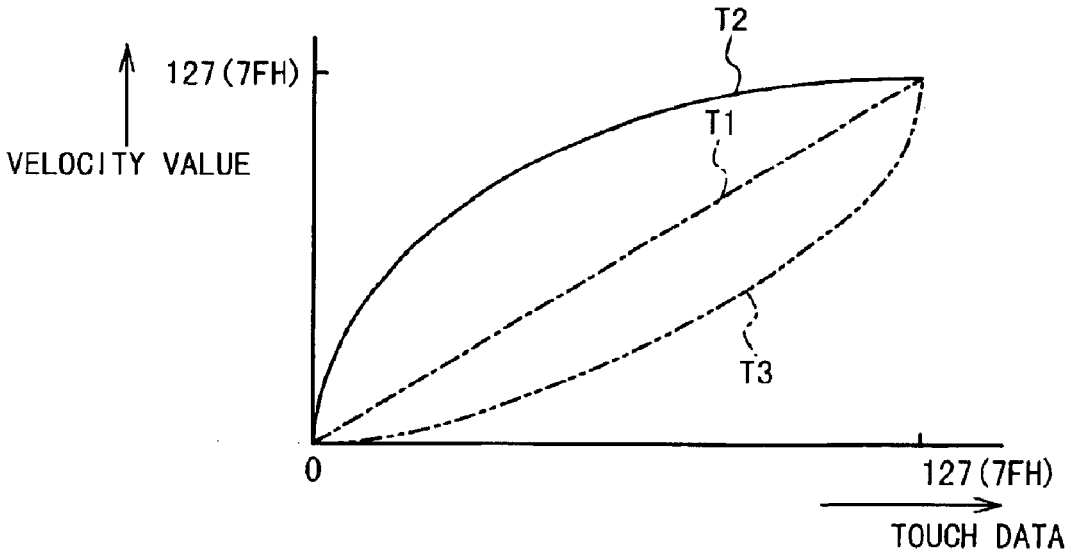
Fig. 2 PRIOR ART
FIG. 2 is a view describing a touch curve in the conventional electronic instrument.

The program memory 11 is composed of, for example, a read only memory (ROM). This program memory 11 stores therein various fixed data used by the CPU 10, in addition to the control program. Also, this program memory 11 includes a touch curve memory 110 for storing therein velocity values that forms a touch curve. In this first embodiment, it is assumed that the touch curve memory 110 stores therein the velocity values that forms three kinds of touch curves T1 to T3, as shown in FIG. 2.

The work memory 12 is composed of, for example, a random access memory (RAM). This work memory 12 transiently stores therein various data when a process is carried out in this electronic instrument. In this work memory 12, a register, a counter, a flag and the like are defined so as to control the electronic instrument. The detailed explanation will be done every time it appears below. This work memory 12 includes a touch data memory 120 for storing therein the touch data from the key scanning circuit 13.

A keyboard device 20 having a plurality of keys is connected to the key scanning circuit 13. This keyboard device 20 is used in order to instruct producing a tone through a key push and instruct silencing the tone through a key release. As the keyboard device 20, for example, a two-contact type keyboard device is used which has in each key the first key switch S1 and the second key switch S2 that are respectively turned on by the different push depth, as described in the column of the conventional techniques.

The key scanning circuit 13 scans the key switches in the keyboard device 20, in response to a command from the CPU 10, and generates a key data in accordance with a signal indicative of an open or close state of the key switches obtained from this scanning operation. The key data is composed of a bit string in which each key corresponds to one bit. In each bit, for example, "1" denotes that the key is pushed, and "0" denotes that the key is released. The key scanning circuit 13 generates "1" when the first key switch S1 is turned on, and generates "0" when the first key switch S1 is turned off. The generated key data is sent through the system bus 30 to the CPU 10.

Figure 1:
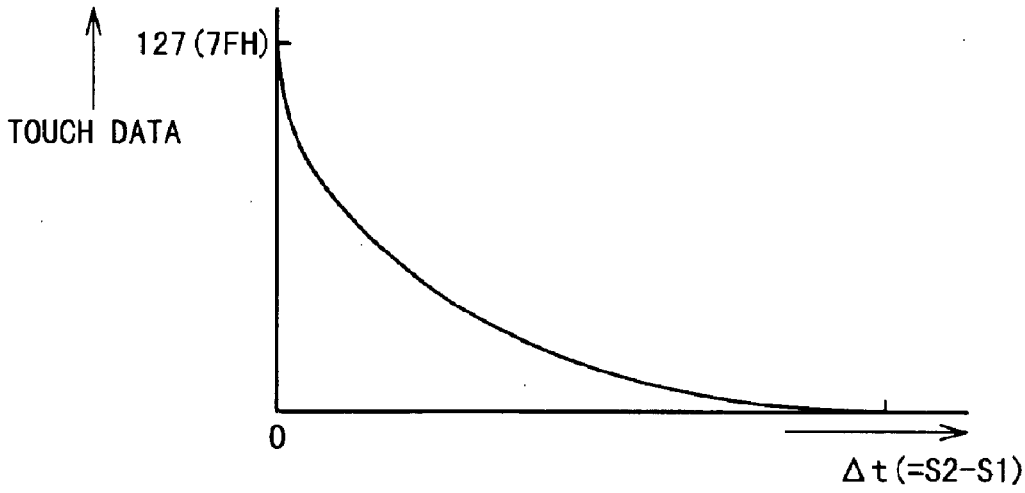
Fig. 1 PRIOR ART
FIG. 1 is a view describing a relation between a key push speed and a touch data in a conventional electronic instrument.

The key scanning circuit 13 measures a time until the second key switch S2 is turned on after the first key switch S1 is turned on by the key push. The time is used as the key push speed Δt. Then, the touch data is generated on the basis of the key push speed Δt. That is, as shown in FIG. 1, the key scanning circuit 13 converts the key push speed Δt into a 128-stage digital data, and outputs as the touch data. This touch data is sent through the system bus 30 to the CPU 10. In accordance with any of the touch curves T1 to T3 selected at that time, the CPU 10 reads out the velocity value corresponding to the input touch data from the touch curve memory 110, and thereby controls a sound volume.

Figure 4:
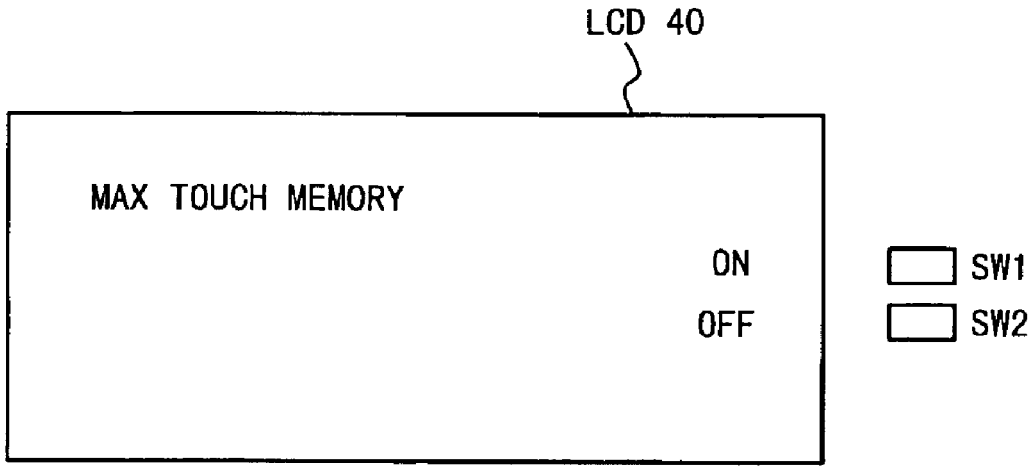
FIG. 4 is a view showing an example of an operation panel shown in FIG. 3.

An operation panel 21 is connected to the panel scanning circuit 14. The operation panel 21 has an LCD 40 and switches SW1, SW2, as shown in FIG. 4. In the actual electronic instrument, in addition to the above-mentioned devices, various panel switches, LEDs for displaying the setting states of those panel switches and the like are mounted on the operation panel 21. However, the illustrations thereof are omitted. The LCD 40 displays various messages. The switches SW1, SW2 are used for a user to give various instructions to the electronic instrument, in response to the message displayed in the LCD 40.

The panel scanning circuit 14 scans the switch on the operation panel 21, in response to the command from the CPU 10, and generates a panel data in accordance with a signal indicative4 of an open or close state of each switch obtained from this scanning operation. The panel data is composed of a bit string in which each switch corresponds to one bit. In each bit, for example, "1" denotes an on state, and "0" denotes an off state. This panel data is sent through the system bus 30 to the CPU 10. The CPU 10 judges whether or not there is a panel event, in accordance with the received panel data. Also, the panel scanning circuit 14 sends display data sent from the CPU 10 to the LCD 40. The LCD 40 displays the message on the basis of the display data composed of a character data and a figure data sent from the CPU 10.

The music tone generator 15 generates a digital music tone signal in response to the command from the CPU 10. The digital music tone signal generated by this music tone generator is sent to a D/A converter 22. The D/A converter 22 converts the received digital music tone signal into an analog music tone signal, and sends to an analog signal processor 23. The analog signal processor 23 adds an audio effect signal to the analog music tone signal, and sends to an amplifier 24. The amplifier 24 amplifies the signal from the analog signal processor 23, and sends to a speaker 25. Accordingly, the music tone is generated from the speaker 25.

Now, the operation for changing the touch response in the electronic instrument having the above-mentioned configuration will be described below.

Figure 5:
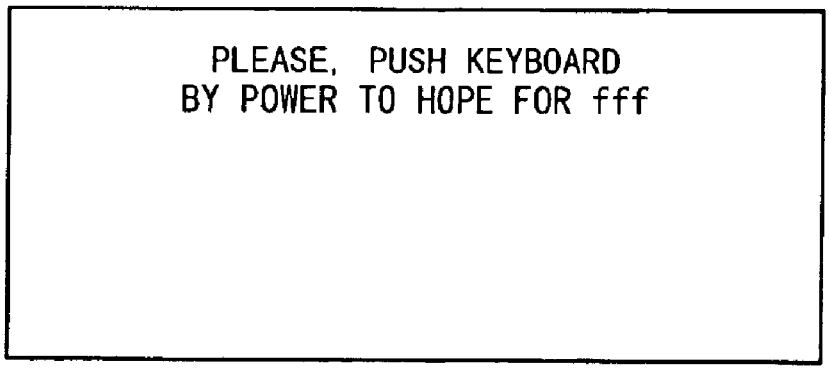
FIG. 5 is a view showing a first display example on the operation panel shown in FIG. 3.

First, the user switches an operation mode of the electronic instrument to a maximum touch memory mode by using a mode setting function usually installed in the electronic instrument. In this case, it is desirable to have been selected the normal touch curve T1 in advance. This maximum touch memory mode corresponds to a predetermined operation mode in the present invention. When the sequence proceeds to the maximum touch memory mode, a message of "MAX TOUCH MEMORY ON OFF" is displayed on the LCD 40, as shown in ad FIG. 4. When the switch SW1 is pushed at this state, a message of "PLEASE, PUSH KEYBOARD BY POWER TO HOPE FOR fff" is displayed on the LCD 40, as shown in FIG. 5. Under this condition, the user can enter a data indicative of a maximum touch (hereafter, referred to as "maximum touch data").

Figure 6:
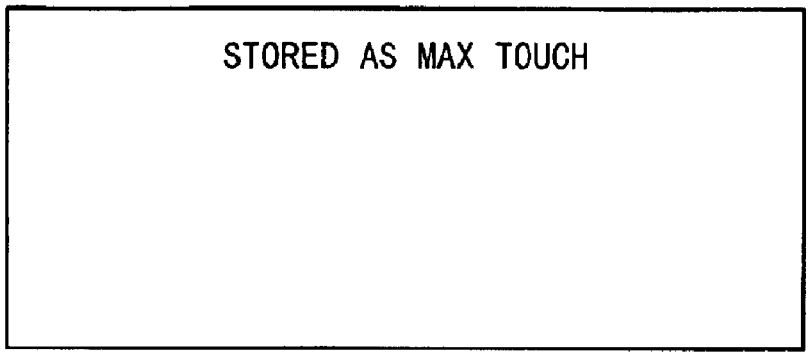
FIG. 6 is a view showing a second display example on the operation panel shown in FIG. 3.
Figure 7:
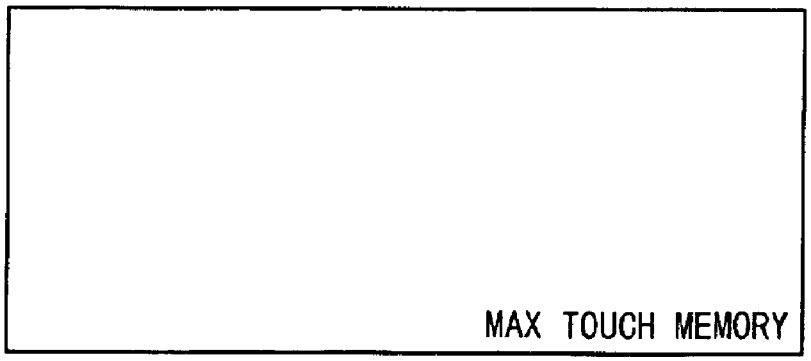
FIG. 7 is a view showing a third display example on the operation panel shown in FIG. 3.

Under this condition, when the user pushes any key on the keyboard device 20 with a force desired to be set as a maximum touch, a message of "STORED AS MAX TOUCH" is displayed on the LCD 40, as shown in FIG. 6. After that, the sequence returns back to the display shown in FIG. 4. At this time, a message of "MAX TOUCH MEMORY" indicative of the change in the touch response is displayed at a lower right corner of the LCD 40, with small characters, as shown in FIG. 7. After that, in accordance with the maximum touch data, the velocity value is changed and used for the producing the tone. It should be noted that the message of "MAX TOUCH MEMORY" displayed with the small characters is continued until the switch SW2 is pushed in the maximum touch memory mode i.e. the state in which the message shown in FIG. 4 is displayed on the LCD 40.

Next, the operation of the electronic instrument having the above-mentioned configuration will be described below with reference to flowcharts shown in FIGS. 8 to 11.

(1-1) Main Process

Figure 8:
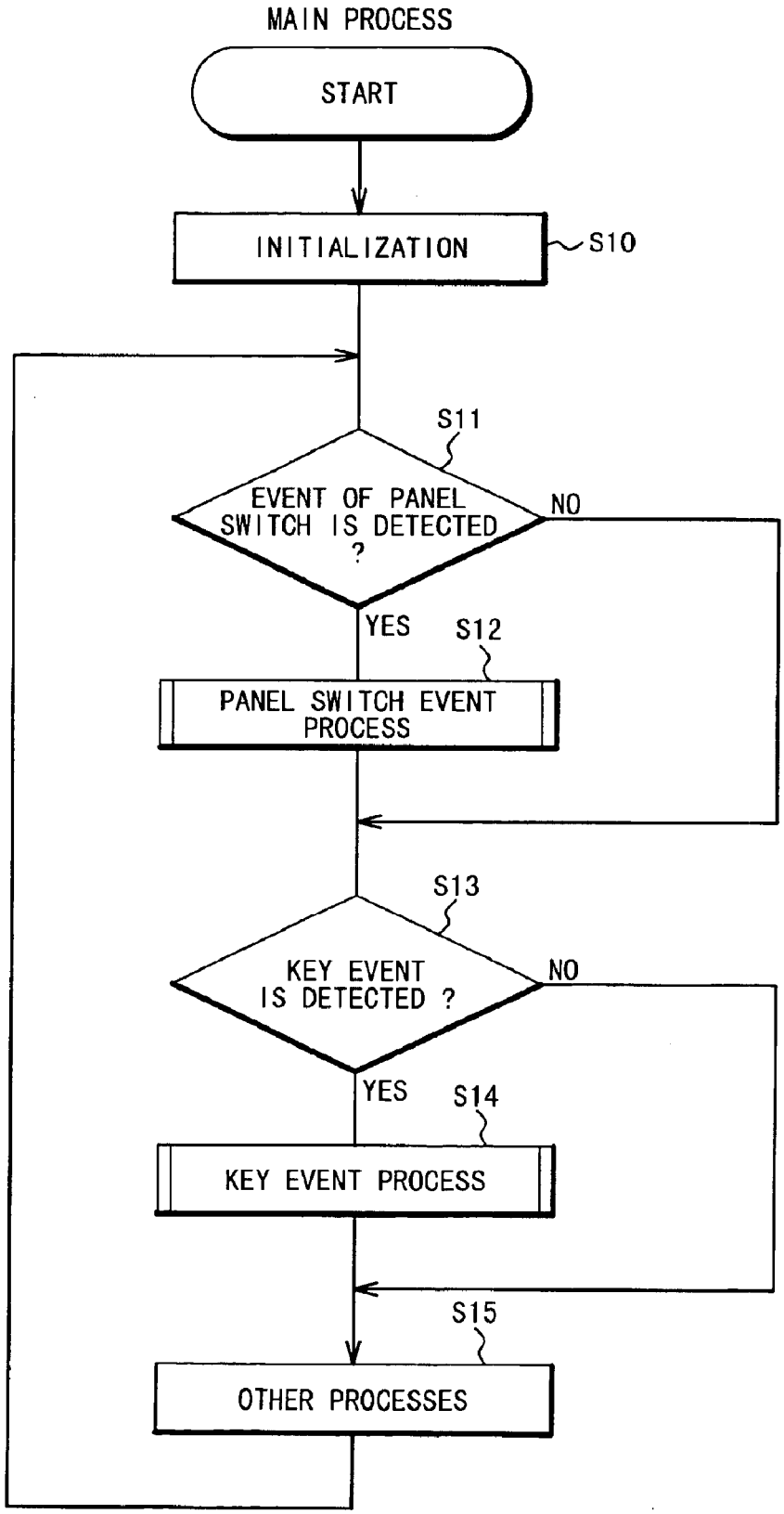
FIG. 8 is a flowchart showing a main process of the electronic instrument to which the touch control apparatus according to the first embodiment of the present invention is applied.

FIG. 8 is the flowchart showing a main process of the electronic instrument to which the touch control apparatus according to the first embodiment of the present invention is applied. This main process routine is actuated by turning on a power supply. When the power supply is turned on, an initialization is firstly carried out (Step S10). In this initialization, a hardware within the CPU 10 is set at an initial state, and initial values are set for the register, the counter, the flag and the like which are defined in the work memory 12.

When this initialization is completed, it is then investigated whether or not an event of the panel switch is detected (Step S1). That is, the CPU 10 captures a panel data (hereafter, referred to as "new data") from the panel scanning circuit 14, and stores in a new panel data register defined in the work memory 12. Then, an exclusive OR operation is carried out between the new panel data and a old panel data which is already captured at the step S11 in a previous time and stored in an old panel data register defined in the work memory 12 to thereby generate a panel event map. If this panel event map is zero, it is judged that the panel switch event is not detected, and if the panel event map is not zero, it is judged that the panel switch event is detected, respectively.

If the panel switch event is detected at the step S11, a panel switch event process is carried out (Step S12). This process carries out a function assigned to the panel switch from which the event is detected. The panel switch event process will be described later in detail. On the other hand, if the panel switch event is not detected at the step S11, the process of the step S12 is skipped.

Next, it is investigated whether or not a key event is detected (Step S13). That is, the CPU 10 captures a key data (hereafter, referred to as "new key data") from the key scanning circuit 13, and stores in a new key data register defined in the work memory 12. An exclusive OR operation is carried out between the new key data and a old key data which is captured at the step S13 in a previous time and already stored in an old key data register defined in the work memory 12 to thereby generate a key event map. If there is a bit of "1" in this key event map, it is judged that an event of a key corresponding to the bit is occurred. If there is not the bit of "1", it is judged that the key event is not occurred. Whether or not the generated event is an on-event is judged by investigating a bit in the new key data corresponding to the bit which is set at "1" in the key event map. That is, if the corresponding bit in the new key data is set at "1", it is judged that there is the on-event. If the corresponding bit is set at "0", it is judged that there is an off-event.

If the key event is detected, a key event process is carried out (Step S14). In this process, a tone indicated by a key through which the key event is occurred is generated or silenced. This key event process will be described later in detail. On the other hand, if the key event is not detected at the step S13, the process of the step S14 is skipped.

Next, other processes are carried out (Step S15). In this other processes, an MIDI process and the like are carried out. After that, the sequence returns back to the step S11, and the processes at the steps S11 to S15 are repeated. If the panel switch event or the key event is generated on the way of the repetition, or if an MIDI interface circuit (not shown) receives the data, the process corresponding to it is carried out. Accordingly, the various functions are carried out in the electronic instrument.

(1-2) Panel Switch Event Process

Figure 9:
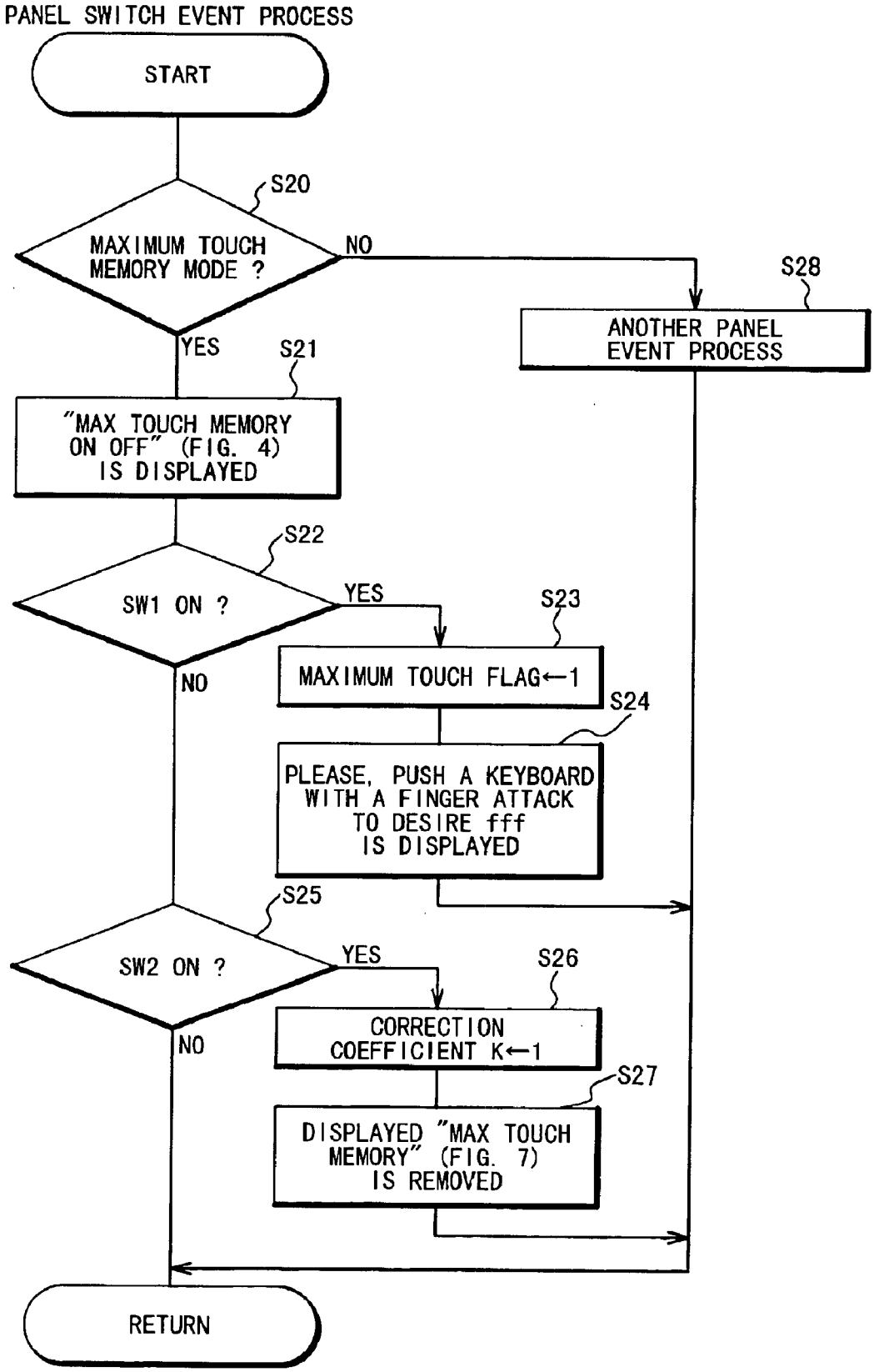
FIG. 9 is a flowchart detailing a panel switch event process shown in FIG. 8.

The panel switch event process carried out at the step S12 of the main process routine will be described below in detail with reference to the flowchart shown in FIG. 9. In this panel switch event process, it is firstly investigated whether or not the operation mode is at a maximum touch memory mode (Step S20). Here, if it is judged as the maximum touch memory mode, the message of "MAX TOUCH MEMORY ON OFF" shown in FIG. 4 is displayed on the LCD 40 (Step S21). Then, it is investigated whether or not there is an on-event of the switch SW1 (Step S22). If it is judged that there is the on-event of the switch SW1, a maximum touch flag is set to "1" (Step S23). The maximum touch flag is defined in the work memory 12. Then, the message of "PLEASE, PUSH KEYBOARD BY POWER TO HOPE FOR fff" shown in FIG. 5 is displayed on the LCD 40 (Step S24). After that, the sequence returns back to the main process routine.

If it is judged at the step S22 that there is not the on-event of the switch SW1, it is then investigated whether or not there is an on-event of the switch SW2 (Step S25). If it is judged that there is the on-event of the switch SW2, a correction coefficient K is set to "1" (Step S26). Then, the message of "MAX TOUCH MEMORY" displayed at the lower right corner of the LCD 40 (refer to FIG. 7) is removed (Step S27). After that, the sequence returns back to the main process routine. If it is judged at the step S25 that there is not the on-event of the switch SW2, the sequence directly returns back to the main process routine.

If it is judged at the step S20 that the operation mode is not at the maximum touch memory mode, another panel event process is carried out (Step S28). In this process, a process corresponding to an event of a panel switch (not shown) is carried out. After that, the sequence returns back to the main process routine.

(1-3) Key Event Process

Figure 10:
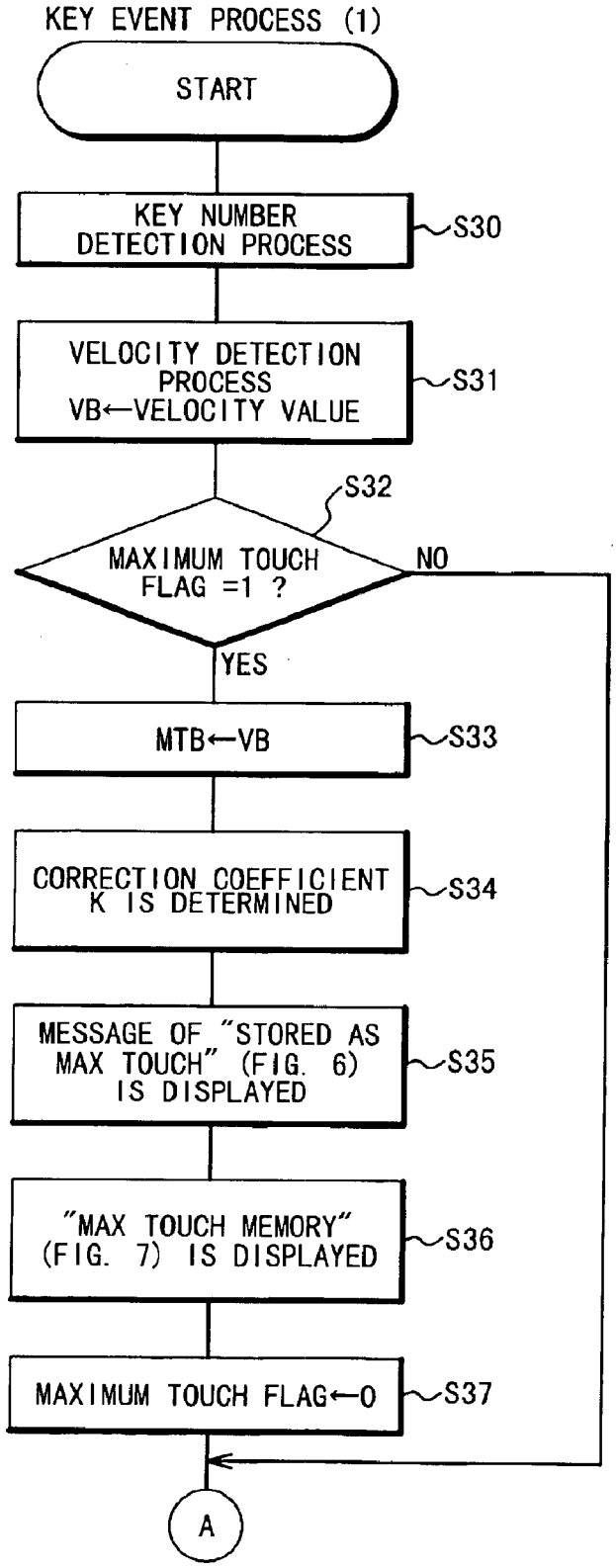
FIG. 10 is a part of a flowchart detailing a key event process shown in FIG. 8.
Figure 11:
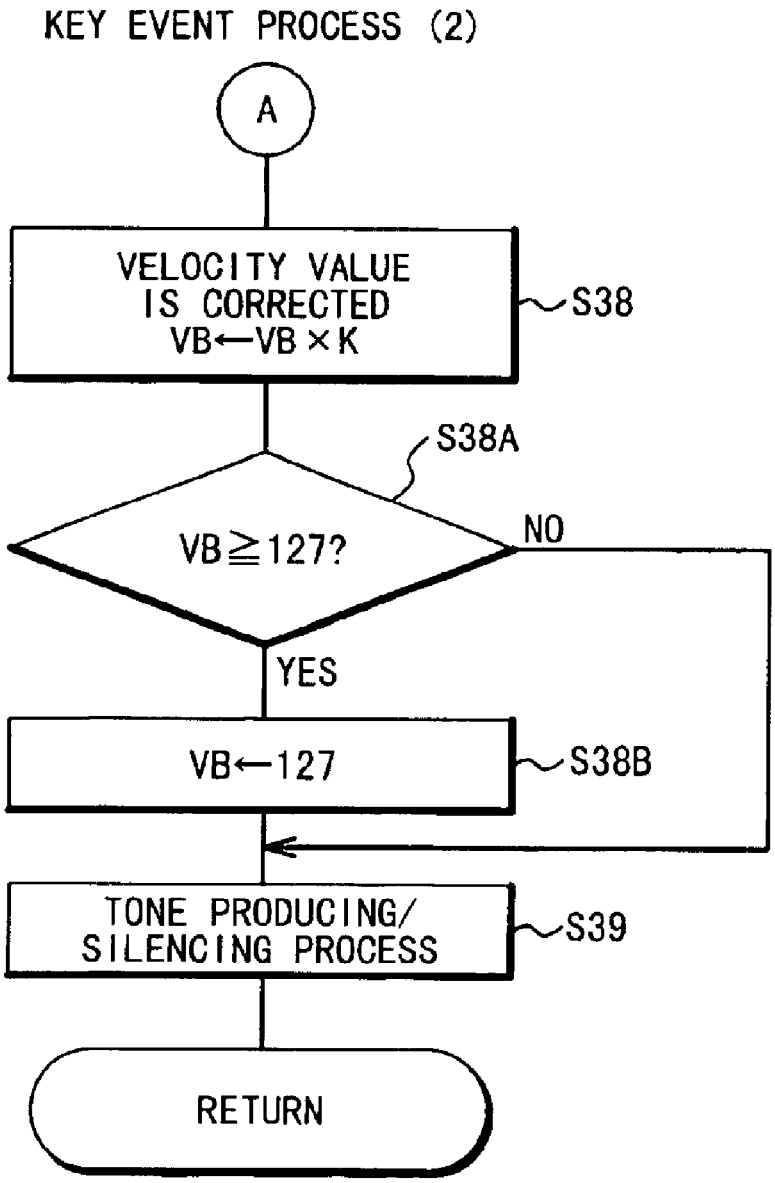
FIG. 11 is another part of the flowchart detailing a key event process shown in FIG. 8.

The key event process carried out at the step S14 of the main process routine will be described below in detail with reference to the flowcharts shown in FIGS. 10 and 11. In this key event process, a key number detection process is firstly carried out (Step S30). In this process, a key number of a key corresponding to a bit which is set at "1" in the key event map is generated. Then, a velocity detection process is carried out (Step S31). In this process, the CPU 10 captures a touch data from the key scanning circuit 13. A velocity value corresponding to the captured touch data is read out from the touch curve memory 110, in accordance with any of the touch curves T1 to T3 have been selected at that time. The read out velocity value is stored in a velocity buffer VB defined in the work memory 12.

Next, it is investigated whether or not the maximum touch flag is set at "1", namely, whether or ru not the operation mode is set at the state that the maximum touch data can be entered (Step S32). If it is judged that the maximum touch flag is set at "1", the velocity value stored in the velocity buffer VB is transferred to a maximum touch buffer MTB defined in the work memory 12 (Step S33). In this case, if a normal touch curve T1 is selected, the touch data from the key scanning circuit 13 is stored in the maximum touch buffer MTB as the velocity value.

Next, the correction coefficient K is determined (Step S34). Here, the velocity value in the electronic instrument according to the first embodiment is represented in a range between 0 and 127. In a minimum sound volume, a velocity value is "0". In a maximum sound volume, a velocity value is "127". In this case, the correction coefficient K is calculated depending on "K=127/(content of MTB)". This correction coefficient is stored in the touch data memory 120 in the work memory 12.

Then, the message of "STORED AS MAX TOUCH" shown in FIG. 6 is displayed on the LCD 40 (Step S35). Thus, the user can check that the setting of the maximum touch data is completed. Thereafter, the message of "MAX TOUCH MEMORY" shown in FIG. 7 is displayed at the lower right corner of the LCD 40, with the small characters (Step S36). Thus, for example, it is possible to avoid the situation in which the play is started without any recognition of a setting of a condition that a large tone is given with a small velocity value, for a child. Then, the maximum touch flag is cleared to "0" (Step S37). Thus, the condition at which the maximum touch data can be entered is ended. If it is judged at the step S32 that the maximum touch flag is set at "0", the processes at the steps S33 to S37 are skipped.

Next, the velocity value is corrected (Step S38). That is, the velocity value stored in the velocity buffer VB at the step S31 is multiplied by the correction coefficient K read out from the touch data memory 120, and a new velocity value is calculated. The calculated velocity value is stored in the velocity buffer VB. It is investigated whether or not the new velocity value stored in the velocity buffer VB is equal to or greater than "127" (Step S38A). If it is judged that the new velocity value is equal to or greater than "127", "127" is stored in the velocity buffer VB (Step S38B). Thus, the maximum value of the velocity value is always limited to "127". Next, a tone producing/silencing process is carried out (Step S39). That is, if a bit in a new key data corresponding to a bit that is set at "1" in the key event map is set at "0", the tone producing process is carried out. If the bit in the new key data corresponding to the bit that is set at "1" in the key event map is set at "0", the tone silencing process is carried out. In the tone producing process, a tone parameter is generated in accordance with the key number detected at the step S30 and the new velocity value obtained at the step S38, and sent to the music tone generator 15. Thus, a tone having a height indicated by the key number and a sound volume indicated on the basis of the velocity value is generated.

On the other hand, in the tone silencing process, an envelope data in which a release speed is made faster is sent to the music tone generator 15 to thereby silence the tone indicated by the key number detected at the step S30. After that, the sequence returns back to the main process routine.

Figure 12:
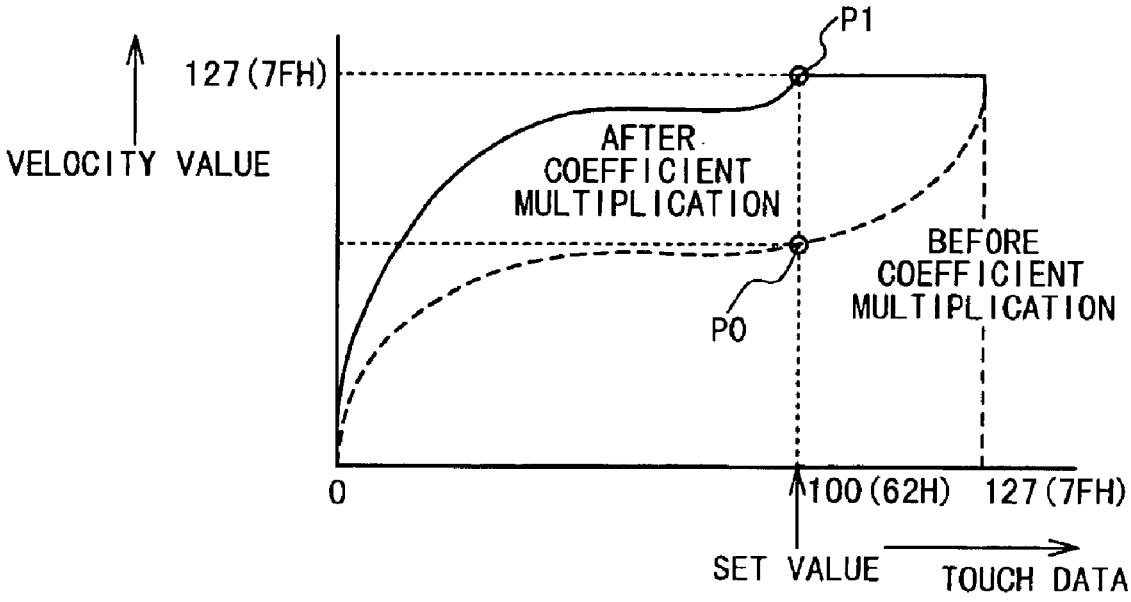
FIG. 12 is a view describing an operation of the electronic instrument to which the touch control apparatus according to the first embodiment of the present invention is applied.

FIG. 12 shows a state in which the touch curve is corrected by the above processes. FIG. 12 shows an example of a touch curve when the maximum touch data is "100". In this case, the correction coefficient K is "127÷100=1.27". Thus, in a touch data in a range between 0 and 100, a touch curve after a coefficient multiplication denoted by a solid line is obtained by multiplying the respective velocity values forming a touch curve before a coefficient multiplication represented by a dashed line by "1.27". If the tone is produced in accordance with the touch curve denoted by the solid line, the velocity value becomes 127 when the touch data is "100". So, the maximum sound volume can be obtained. Thus, it is possible to attain the touch response suitable for the user in the low age group or the high age group having the weak keying power. It should be noted that the velocity value is always "127" for the touch data greater than "100". In this case, the maximum sound volume can be obtained always.

In the touch control apparatus according to the first embodiment, only one hit with a force, which the user considers as the maximum keying power, enables the velocity value forming the touch curve to be increased in accordance with the keying power of the user. Thus, a large sound volume can be produced with a weak keying power. In this way, the user can adjust the electronic instrument so as to obtain a desirable touch response by using an easy operation in a short time.

The first embodiment is designed such that the correction coefficient K is generated when any of the keys on the keyboard device 20 is pushed, in the condition that the maximum touch data can be entered. However, it may be designed such that the correction coefficient K is generated only when a particular key or a plurality of particular keys are pushed.

The LCD is used to display the message. However, an LED can be used instead of the LCD. In this case, it may be designed such that the LED is alternatively turned on and off at a condition that the maximum touch data can be entered, and then the LED is continuously turned on after inputting the maximum touch data. According to this configuration, the present invention can be applied to a low-level model having no LCD.

Also, it may be designed such that a plurality of touch data memories 120 are prepared in the work memory 12, and the correction coefficient K stored in any of the touch data memories is used to produce the tone. According to this configuration, when one electronic instrument is used by a plurality of users, if each user stores the maximum touch data in the touch data memory, it is not necessary to set the maximum touch data every usage. Thus, it is possible to instantly set the touch response suitable for each user.

Also, the first embodiment is designed such that the new velocity value used for producing the tone is calculated every time the tone producing process is carried out. However, the following configuration may be considered. That is, a new velocity value corresponding to all the touch data is calculated at the time of the input of the maximum touch data, and it is stored in a table. At the time of the execution of the tone producing process, the velocity value is determined by referring to this table. This configuration does not require the calculation of the new velocity value at the time of the tone producing process. Thus, the speed of the tone pronouncing process is improved.

Moreover, the first embodiment is designed such that the maximum touch data is obtained by actually operating the keyboard device. However, for example, the following configuration may be considered. That is, a numeral input device, such as a ten key, a dial, an up-down switch or the like, mounted on the operational panel, can be used to the input maximum touch by the numeral.

(Second Embodiment)

A touch control apparatus according to a second embodiment of the present invention has a correction curve that can be adjusted by a user, in addition to a keyboard curve. A series of controls in which the correction curve is used to correct the keyboard curve and accordingly obtain a velocity value to be used for producing a tone is referred to as UCC (User Curve Control), hereafter.

Figure 13:
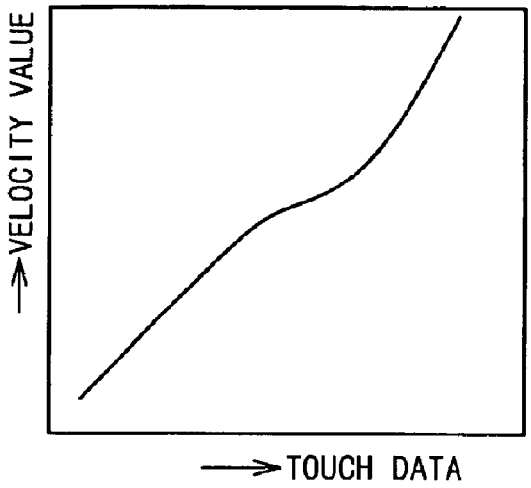
FIG. 13 is a view showing an example of a keyboard curve in an electronic instrument to which a touch control apparatus according to a second embodiment of the present invention is applied.

FIG. 13 shows an example of the keyboard curve. Here, the keyboard curve is defined as follows. The key push speed Δt (refer to FIG. 1) outputted from a touch sensor contained in a keyboard device is different between a white key and a black key. Also, the key push speed Δt is varied depending on the kind of the keyboard device. When the key is pushed under the predetermined force, a touch data is corrected such that a predetermined value is outputted irrespectively of the difference between the white key and the black key and the kind of the keyboard device. The keyboard curve defines the relation between this corrected touch data and the velocity value. The touch control apparatus according to the second embodiment outputs a correction value obtained by further correcting the keyboard curve in accordance with a correction curve shown in FIG. 14, as a final velocity value.

Figure 14:
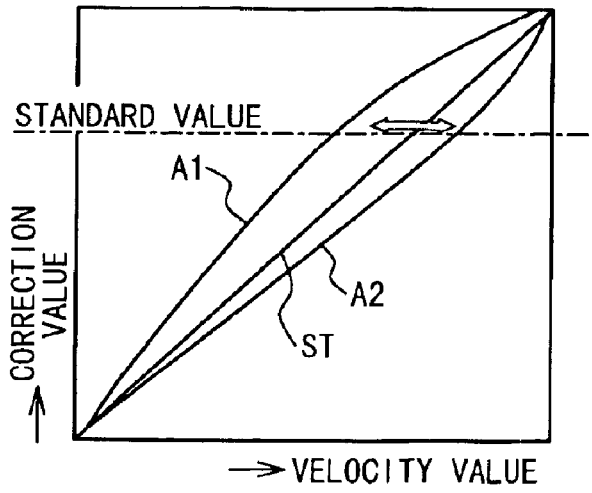
FIG. 14 is a view describing an example of a correction curve in the electronic instrument to which the touch control apparatus according to the second embodiment of the present invention is applied.
Figure 15:
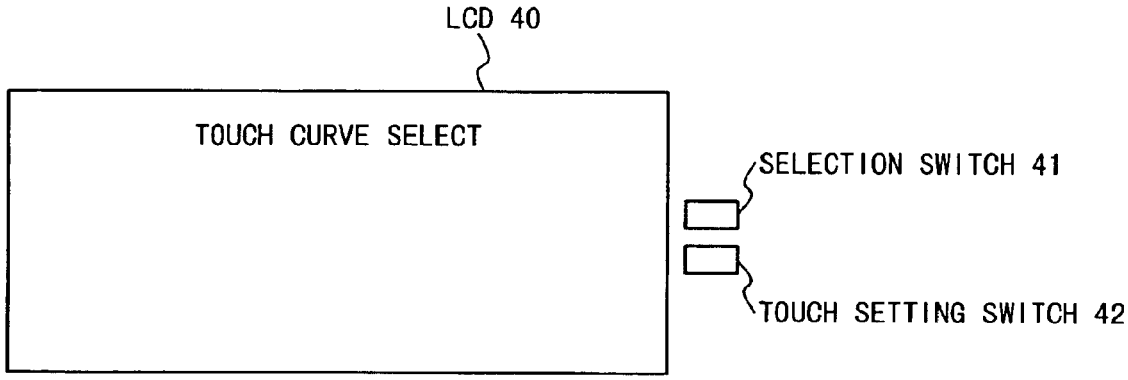
FIG. 15 is a view showing an example of the operation panel in the electronic instrument to which the touch control apparatus according to the second embodiment of the present invention is applied.

FIG. 14 shows a correction table for defining the relation between the velocity value and the correction curve. Correction curves A1, A2 in this correction table are produced by arranging a standard curve ST, in accordance with a difference between a pre-determined standard value and a velocity value obtained by converting a touch data produced by a user's keying operation based on the keyboard curve. The process for generating the correction curve will be described later in detail.

The configuration of the electronic instrument according to the second embodiment is similar to that of the electronic instrument to which the touch control apparatus according to the first embodiment shown in FIG. 3 is applied, except the configuration of the operation panel. Thus, a configuration and an operation of the operation panel will be mainly described below.

An operation panel 21 includes an LCD 40, a selection switch 41 and a touch setting switch 42. The LCD 40 is used to display various messages.

In this second embodiment, let us suppose that three kinds of touch curves T1 to T3, which is shown in FIG. 2, such as "Normal", "Light" and "Heavy" are used. The selection switch 41 is used to select any of the three kinds of touch curves and the correction curve.

The touch setting switch 42 is used to obtain a touch data to be used for producing the correction curve. That is, when a key on the keyboard device 20 is pushed in such a condition that the touch setting switch 42 is pushed, the correction curve is produced by using the touch data obtained at that time.

Next, the operation for producing the correction curve in the electronic instrument having the above configuration will be described below.

At first, an operation mode of the electronic instrument is switched to a touch curve selection mode by using a mode setting function generally provided in the electronic instrument. In this touch curve selection mode, every time the selection switch 41 is pushed, the touch curve is circularly selected such as "Normal"→"Light"→"Heavy"→"User"→"Normal"→ . . . Here, "User" indicates an operation mode in which the velocity value is calculated based on the correction curve and the music tone is produced.

When the touch setting switch 42 is pushed down in the condition that "User" is selected by the selection switch 41, this touch control apparatus is lead such a condition that the touch data to be used for producing the correction curve can be entered. In this condition, the user hits the keys on the keyboard device 20, for example, with strength of mezzo forte, a plurality of times. The data in which an average of a plurality of touch data obtained through a plurality of hitting operations is calculated is referred to as "mf touch-data".

When the touch setting switch 42 is released, the correction curve is produced based on the mf touch data. When the keyboard device 20 is operated under the condition that "User" is selected, the tone is generated based on the velocity value corrected in accordance with the produced correction curve.

Figure 16:
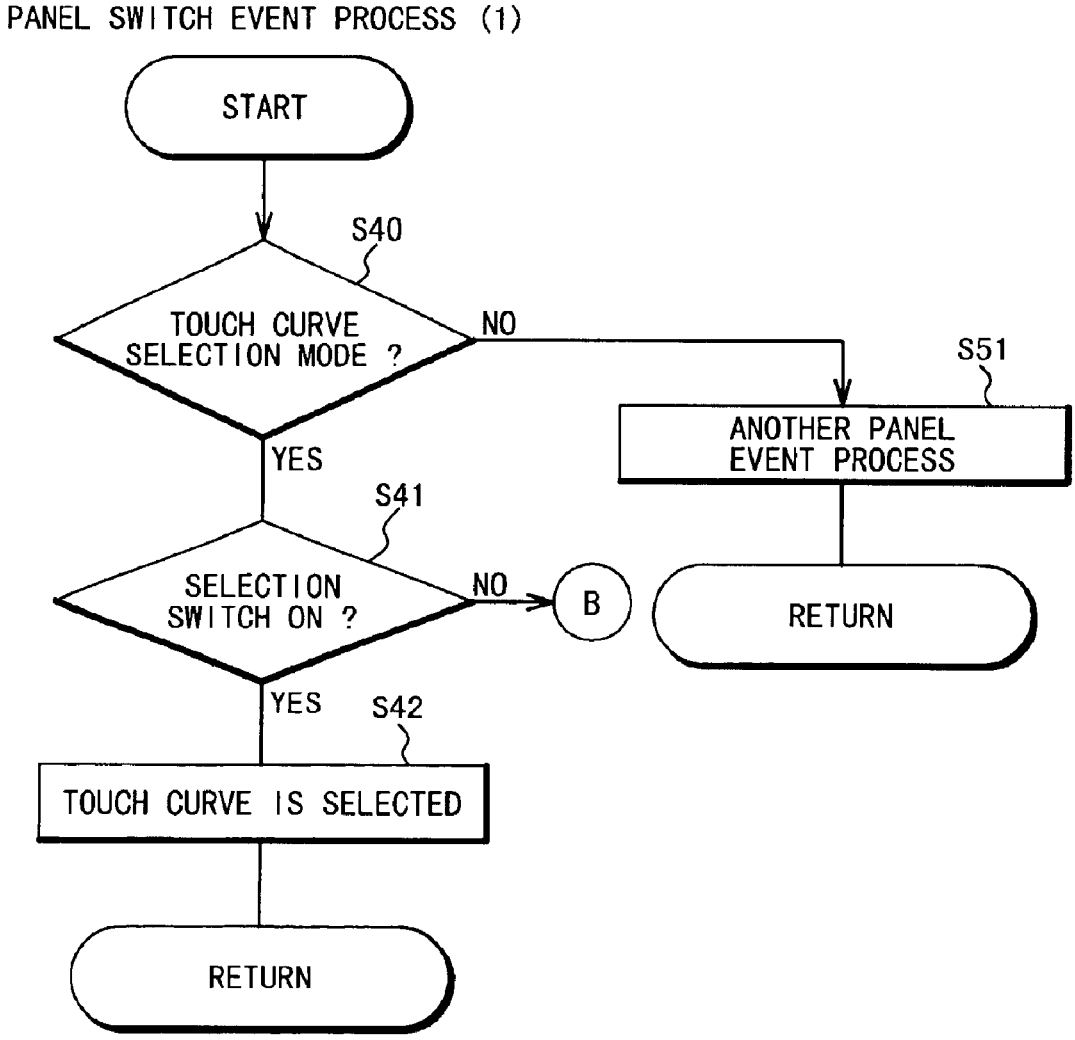
FIG. 16 is a part of a flowchart detailing a panel switch event process of the electronic instrument to which the touch control apparatus according to the second embodiment of the present invention is applied.
Figure 17:
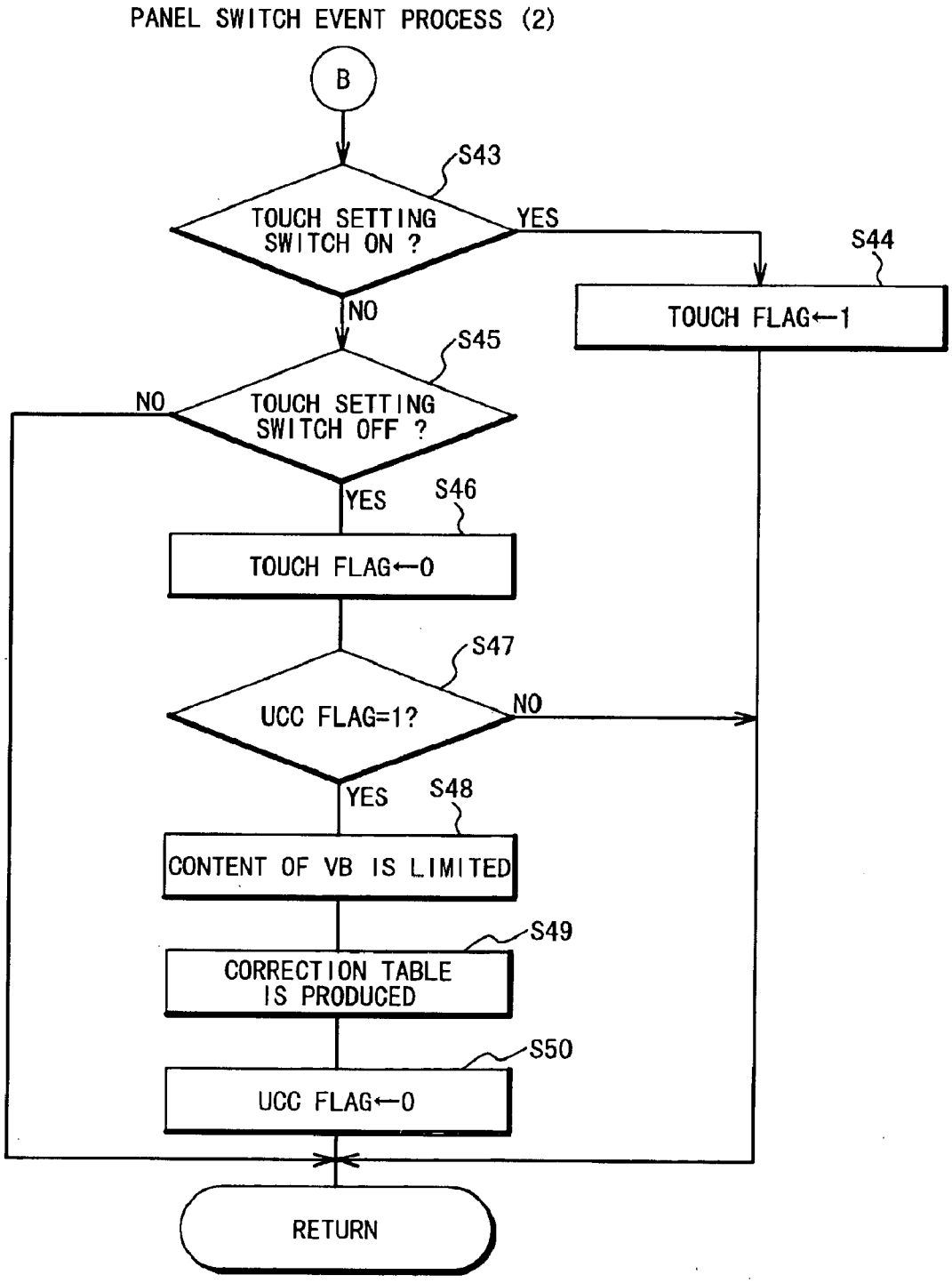
FIG. 17 is another part of a flowchart detailing the panel switch event process of the electronic instrument to which the touch control apparatus according to the second embodiment of the present invention is applied.
Figure 18:
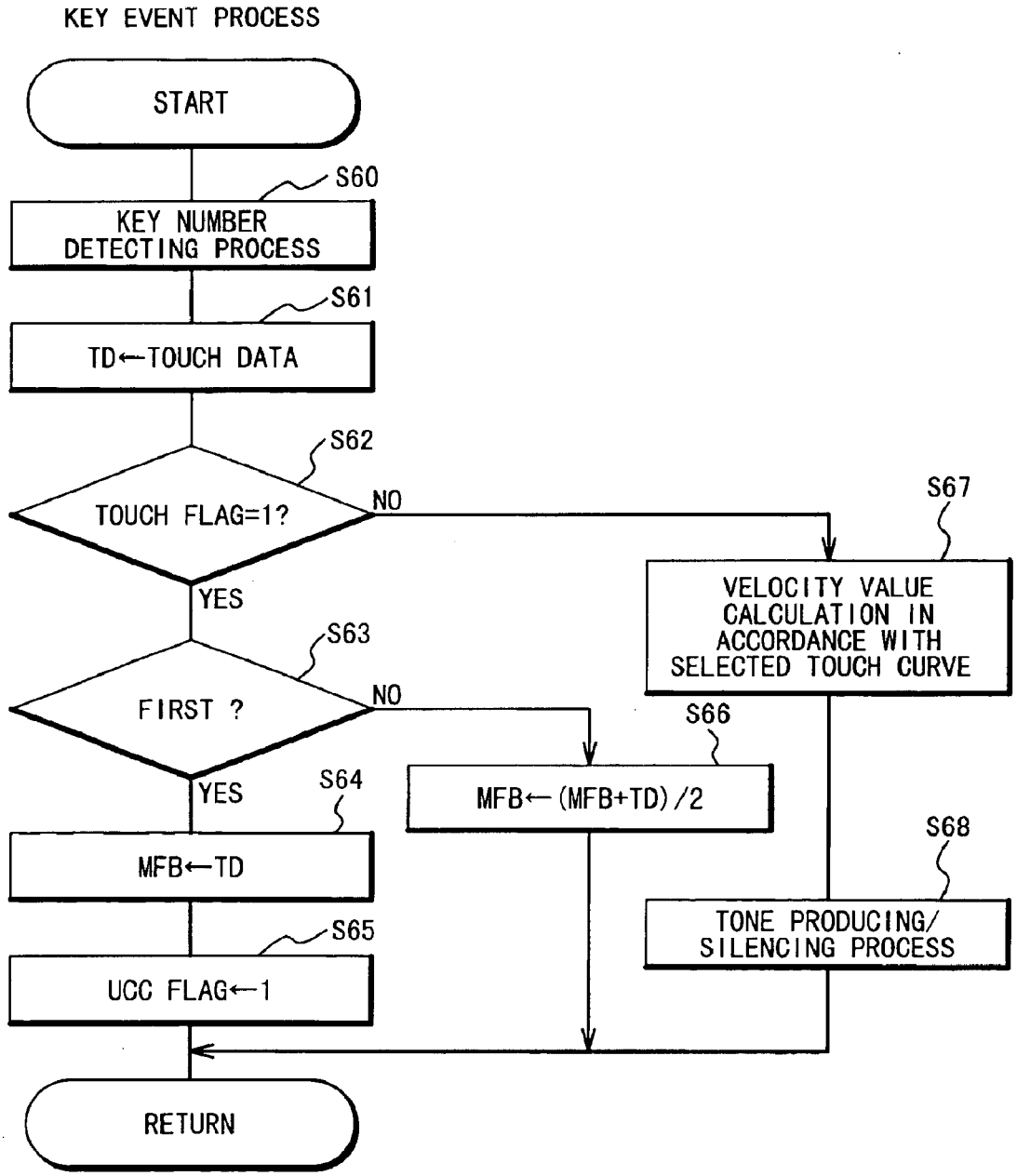
FIG. 18 is a flowchart detailing a key event process of the electronic instrument to which the touch control apparatus according to the second embodiment of the present invention is applied.

Next, the operation of the electronic instrument to which the touch control apparatus having the above configuration is applied will be described below with reference to flowcharts shown in FIGS. 16 to 18.

(2-1) Main Process

The content of a main process is identical to that of the first embodiment.

(2-2) Panel Switch Event Process

The panel switch event process carried out at the step 512 in the main process routine will be described below with reference to the flowcharts shown in FIGS. 16, 17. In this panel switch event process, it is firstly investigated whether or not the operation mode is set at a touch curve selection mode (Step S40). If it is judged that the operation mode is set at the touch curve selection mode, it is investigated whether or not there is an on-event of the selection switch 41 (Step S41). If it is judged that there is the on-event of the selection switch 41, the selection of the touch curve is carried out (Step S42). For example, if the selection switch 41 is pushed under the condition that the normal touch curve is selected, the light touch curve is selected. After that, the sequence returns back to the main process routing.

If it is judged at the step S41 that there is not the on-event of the selection switch, it is investigated whether or not there is an on-event of the touch setting switch 42 (Step S43). If it is judged that there is the on-event of the touch setting switch 42, the touch flag defined in the work memory 12 is set to "1" (Step S44). After that, the sequence returns back to the main process routine.

On the other hand, if it is judged that there is not the on-event of the touch setting switch 42, it is investigated whether or not an off-event of the touch setting switch 42 (Step S45). If it is judged that there is the off-event of the touch setting switch 42, the touch flag is cleared to "0" (Step S46). The fact that the touch flag is set at "0" implies such a condition that the touch setting switch 42 is not pushed. Through the operations of the steps S43 to S46, the touch flag is set to "1" while the touch setting switch 42 is pushed, and cleared to "0" while it is released. If it is judged at the step S45 that there is not the off-event of the touch setting switch 42, the sequence returns back to the main process routine.

When the process at the step S46 is completed, it is investigated whether or not a UCC flag defined in the work memory 12 is set at "1" (Step S47). This UCC flag is set when a first hitting operation to enter the mf touch data is carried out in a later-described key event process routine. Thus, the fact that the UCC flag is set at "1" when the touch setting switch 42 is turned off implies that the mf touch data is stored in the velocity buffer VB. Hence, the process for producing the correction curve is carried out in the following steps 548 to 550. On the other hand, if it is judged that the UCC flag is set at "0", it is recognized that the mf touch data is not still stored in the velocity buffer VB. The sequence returns back to the main process routine.

In the process for producing the correction curve, the content of the velocity buffer VB is firstly limited to a predetermined value (Step S48). For example, if the mf touch data stored in the velocity buffer VB is smaller than "60", the content is limited to "60", and if it is greater than "100", the content is limited to "100", respectively. Accordingly, the mf touch data is kept at the realistic value.

Next a correction table is produced (Step S49). The process for producing the correction table will be described later in detail. Next, the UCC flag is cleared to "0" (Step S50). After that, the sequence returns back to the main process routine.

If it is judged at the step S40 that the operation mode is not at the touch curve selection mode, another panel event process is carried out (Step S51). In this process, a process with regard to an event of another panel switch (not shown) is carried out. After that, the sequence returns back to the main process routine.

(2-3) Key Event Process

The key event process carried out at the step S14 of the main process routine will be described below in detail with reference to the flowchart shown in FIG. 18. In this key event process, a process for detecting a key number is firstly carried out (Step S60). In this process, a key number of a key corresponding to a bit that is set at "1" in the key event map is generated. Then, the touch data is captured from the key scanning circuit 13, and stored in a touch data buffer TD (Step S61).

Then, it is investigated whether or not the touch flag is set at "1", namely, whether or not the touch setting switch 42 is pushed (Step S62). If it is judged that the touch flag is set at "0", a velocity value is calculated in accordance with any of the touch curves T1 (Normal), T2 (Light) and T3 (Heavy) and the correction curve have been selected at that time (Step S67). That is, the velocity value corresponding to the captured touch data is read out from the correction table in the work memory 12 or the touch curve memory 110 in the program memory 11, and stored in the velocity buffer VB.

Then, the tone producing/silencing process is carried out (Step S68). That is, if a bit in a new key data corresponding to a bit that is set at "1" in the key event map is set at "1", the tone producing process is executed. If the bit in the new key data corresponding to the bit that is set at "1" in the key event map is set at "0", the tone silencing process is executed. In the tone producing process, a tone parameter is generated in accordance with the key number detected at the step S60 and the velocity value obtained at the step S67, and sent to the music tone generator 15. Thus, a tone having a height indicated by the key number and a sound volume indicated on the basis of the velocity value is generated. The silencing process is carried out with similarly manner to the case of the first embodiment. Then, the sequence returns back to the main process routine.

On the other hand, if it is judged at the Step S62 that the touch flag is set at "1", it is investigates whether or not the key event currently being treated is a key event produced by a first hitting operation after the touch setting switch 42 is pushed (Step S63). This process is performed by investigating whether or not the UCC flag is set at "0". If it is judged as the key event produced by the first hitting operation, a content of the touch data buffer TD defined in the work memory 12 is stored in a buffer MFB defined in the work memory 12 (Step S64). Then the UCC flag is set to "1" (Step S65). Thereafter, the sequence returns back to the main process routine.

If it is judged at the step S63 that it is not the key event produced by the first hitting operation, the average of the content of the buffer MFB and the content of the touch data buffer TD is calculated, and its result is stored in the buffer MFB (Step S66). With this process, when the key on the keyboard device 20 is pushed a plurality of times under the condition that the touch setting switch 42 is pushed, the average of a plurality of touch data is calculated, and stored in the buffer MFB. The content of the buffer MFB is used as the mf touch data. After that, the sequence returns back to the main process routine.

Next, the process for producing the correction table carried out at the step S49 in the panel switch event process will be described below in detail. The producing of the correction table is performed as follows. That is, a difference is calculated between a standard value pre-determined as a touch data of mezzo forte and an mf touch data obtained by the user's hitting operation as the strength of the mezzo forte. Then, a velocity value forming a correction curve is determined in accordance with the calculated difference, and stored in the correction table in the work memory 12.

In this producing of the correction table, when the correction curve is represented by a function f(x) in which a corrected velocity value is output and the detected velocity value is a variable, the function f(x) can be defined as a curved line or a straight line. If the function f(x) is defined as the straight line, the function f(x) can be constituted by a plurality of straight lines.

Figure 19:
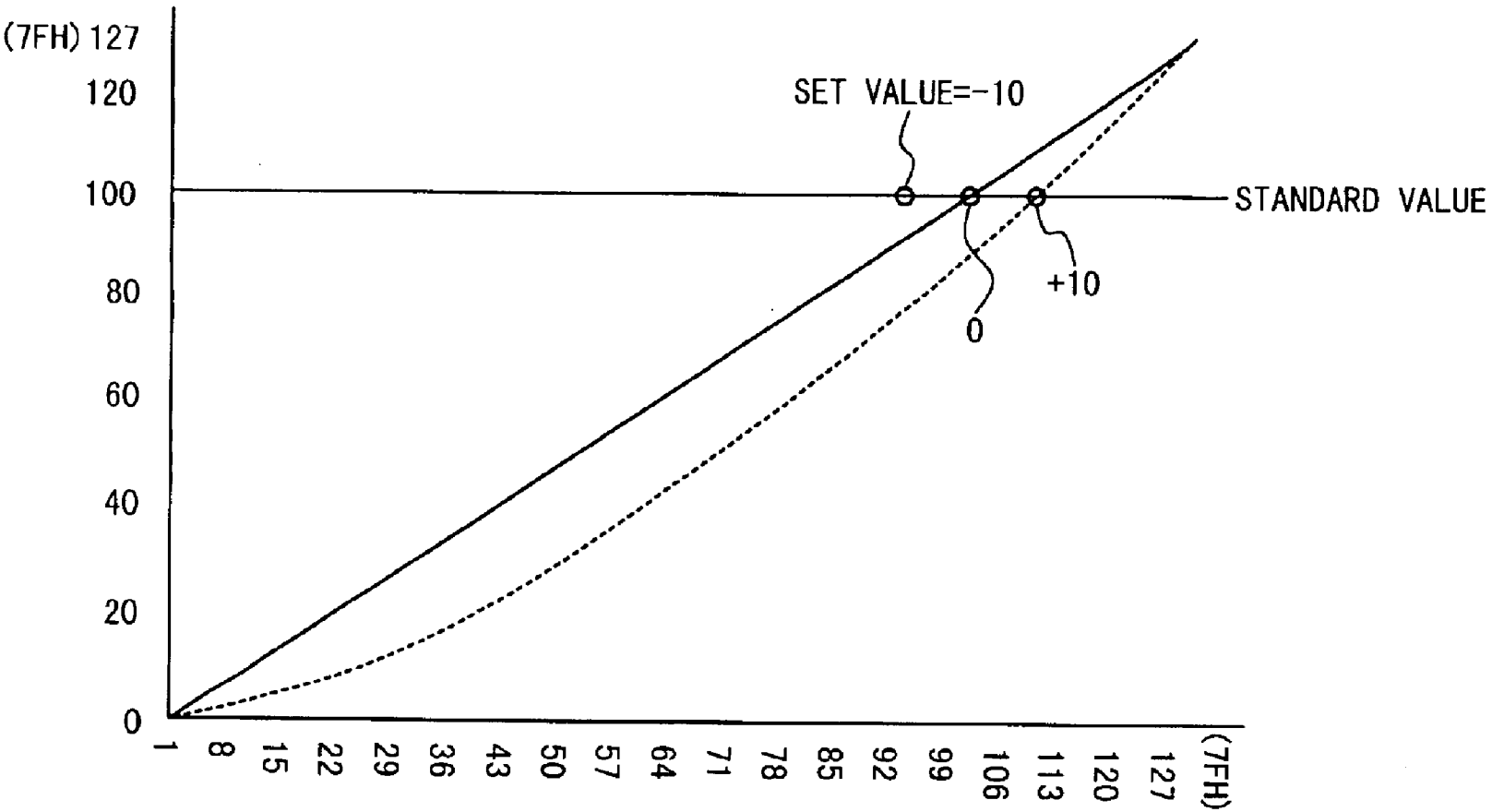
FIG. 19 is a view showing a correction curve formed by a curved line prepared by the touch control apparatus according to the second embodiment of the present invention.

FIG. 19 shows an example when the function f(x) is defined as the curved line. The correction curve line passes through three points of coordinates (0, 0), (a, n) and (m, m). So, when the function f(x) is represented by $f(x)=\alpha x^{\beta}$, the correction curve can be represented by the following equation (1):

$$f(x)=(m/m^{\beta})\times x^{\beta} \qquad \text{Equation (1)}$$

Here, $\beta=\log(m/n)/\log(m/a)$, "n" is a standard value representing a standard velocity of mezzo forte, "a" is a set value actually set as the velocity of the mezzo forte, and "m" is the maximum value "7FH" of the velocity value (the least significant digit H denotes a hexadecimal number). A correction curve "A" in FIG. 19 indicates an example in a case of a=110, m=127 and n=100.

Figure 20:
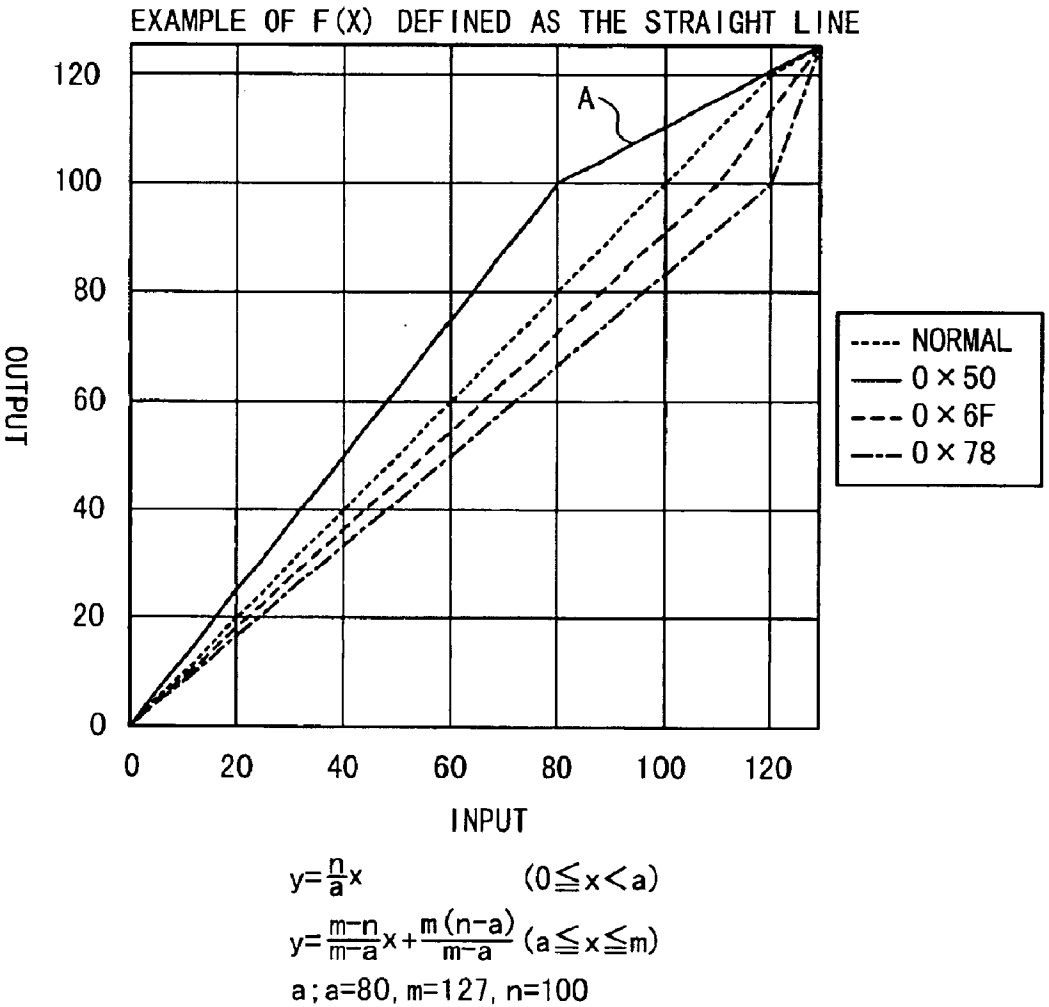
FIG. 20 is a view showing a correction curve formed by a straight line prepared by the touch control apparatus according to the second embodiment of the present invention.

FIG. 20 shows an example when the function f(x) is defined as two straight lines. In this case, when a velocity value "x" is in a range of "$0 \leqq x < a$", the correction curve can be represented by the following equation (2):

$$f(x)=(n/a)\ x \qquad \text{Equation (2)}$$

Also, in a range of "$a \leqq x \leqq m$", the correction curve can be represented by the following equation (3):

$$f(x)=((m-n)/(m-a))x+(m(n-a))/(m-a) \qquad \text{Equation (3)}$$

The correction curve "A" in FIG. 20 indicates an example in a case of a=80, m=127 and n=100.

The second embodiment is designed such that the mf touch data is generated when any of keys on the keyboard device 20 is pushed. However, it may be designed such that the mf touch data is generated only when a particular key or a plurality of particular keys are pushed.

The LCD is used to display the message. However, the LED can be used instead of the LCD. In this case, it may be designed such that the LED is alternatively turned on and off at a condition in which the mf touch data can be entered. Then, under this condition, when the user pushes the keyboard device 20 with the strength of the mezzo forte, the LED can be continuously turned on after the input of the mf touch data. According to this configuration, the present invention can be applied to a cheap electronic instrument having no LCD.

Also, it may be designed such that a plurality of correction tables are prepared in the work memory 12 and then any of the correction tables is selected for generating a tone. According to this configuration, when one electronic instrument is used by a plurality of users, each user can instantly obtain a desirable touch response.

As described above, the second embodiment is designed such that the correction curve is stored in the correction table, and the new velocity value is ark obtained by referring to the correction table at the time of producing the tone. However, it may be designed such that the mf touch data is saved beforehand, and when the tone is produced, the new velocity value is calculated based on the saved mf touch data.

Also, in the second embodiment, a display of a guide message associated with the operation of the operation panel 21 is omitted. However, the guide message can be suitably displayed similarly to the case of the first embodiment.

It is designed such that the mf touch data is inputted by actually operating the keyboard device. However, it may be designed such that the mf touch data is inputted as a numeral by using a numeral input device, such as a ten key, a dial or an up-down switch or the like, mounted on the operational panel.

Figure 21:
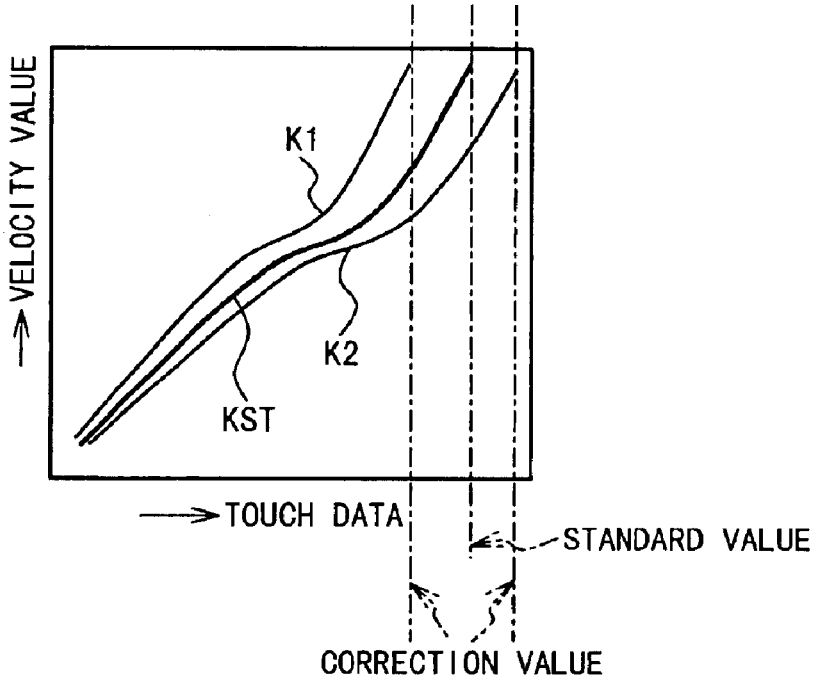
FIG. 21 is a view showing another example of a keyboard curve in the electronic instrument to which the touch control apparatus according to the second embodiment of the present invention is applied.
Figure 22:
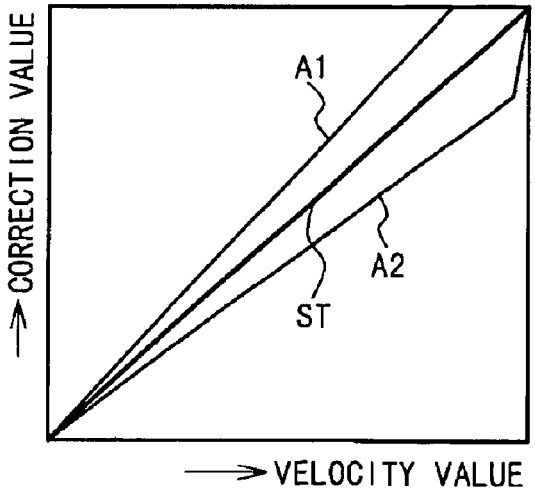
FIG. 22 is a view showing another example of a correction curve in the electronic instrument to which the touch control apparatus according to the second embodiment of the present invention is applied.

Moreover, since the second embodiment employs the velocity value when the key is hit with the mezzo forte as the standard value, it is not limited to the mezzo forte. The velocity value when the key is hit with another strength can be used as the standard value. For example, if the maximum value is used as the standard value, the correction curves A1, A2 shown in FIG. 22 can be obtained. When the correction curves A1, A2 are used for the correction, a keyboard curve KST is corrected to the curves denoted by K1, K2, shown in FIG. 21.

(Third Embodiment)

In an electronic instrument to which a touch control apparatus according to a third embodiment of the present invention is applied, when a user hits the key, its hitting force is displayed on a display.

The configuration of this electronic instrument is identical to that of the electronic instrument to which the touch control apparatus according to the first embodiment shown in FIG. 3 is applied, except the configuration of the operation panel. Thus, a configuration and an operation is mainly described below.

Figure 23:
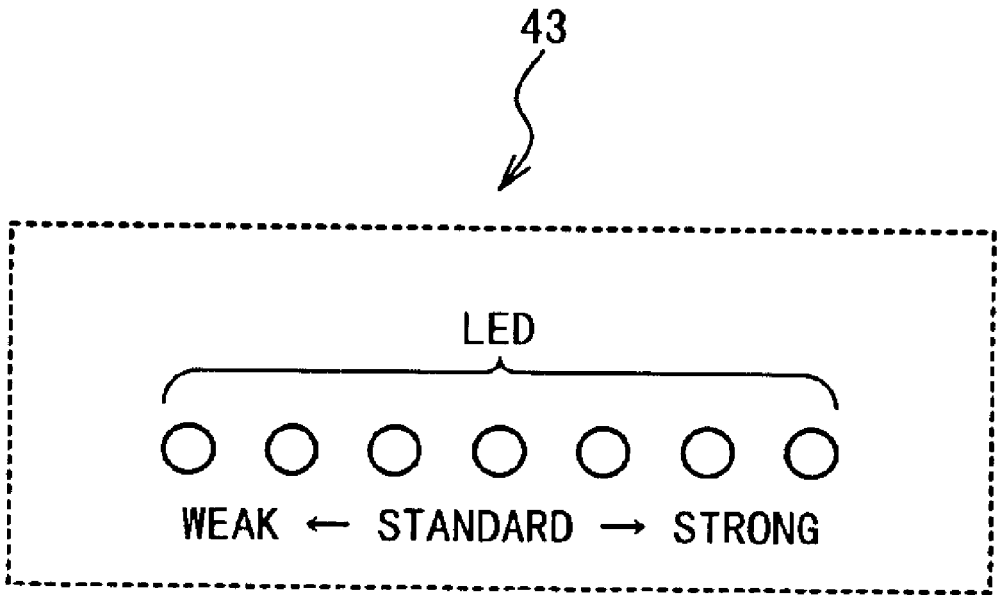
FIG. 23 is a view showing an example of an operation panel of an electronic instrument to which a touch control apparatus according to a third embodiment of the present invention is applied.

An operation panel 21 of the electronic instrument includes a display 43 shown in FIG. 23, in addition to the above-mentioned LCD. This display 43 is composed of a plurality of LEDs. When a key on the keyboard device 20 is pushed, any of the plurality of LEDs is turned on in accordance with a touch data at that time.

Next, an operation of this electronic instrument will be described below. The contents of a main process and a panel event process are identical to those of the first embodiment. So, the explanations thereof are omitted.

Figure 24:
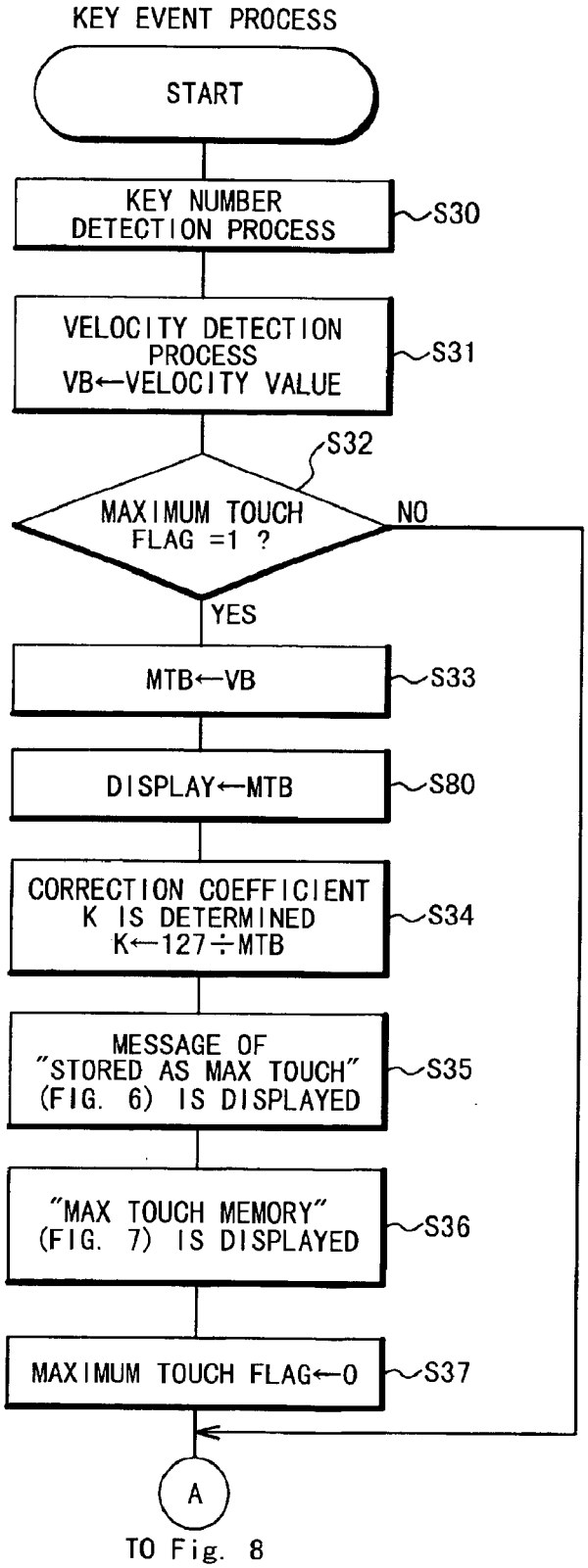
FIG. 24 is a flowchart detailing a key event process of the electronic instrument to which the touch control apparatus according to the third embodiment of the present invention is applied.

FIG. 24 is a part of a flowchart showing a key event process of the electronic instrument. In this key event process routine, a step S80 is newly inserted between the steps S33, S34 in the key event process routine used in the first embodiment shown in FIG. 10. At this step S80, a content of a maximum touch buffer MTB is sent to the display 43. By this operation, when the key on the keyboard device 20 is pushed under such a condition that a maximum touch data can be entered, a keying power at that time is displayed on the display 43.

In the electronic instrument to which the touch control apparatus according to the third embodiment is applied, the user can know his or her keying power by viewing the display 43. Thus, even if a beginner or a child whose keying power is not stable, the maximum touch data can be easily entered.

This third embodiment is designed such that the display 43 of the exclusive use is mounted in order to indicate the hitting force. However, the third embodiment may be designed such that the display 43 is also used as LEDs for another purpose mounted in a usual electronic instrument, e.g. LEDs to display a selected timbre. Also, the display of the keying power may be displayed on the LCD 40 in a graph form.

Also, the third embodiment is designed such that the hitting force is displayed when the maximum touch data is entered. However, it may be designed such that the hitting force is displayed when the mf touch data explained in the second embodiment is entered. In this case, a step for carrying out a process similar to that of the step S80 may be inserted between the steps S64, S65 in the key event process routine used in the second embodiment shown in FIG. 18.

(Fourth Embodiment)

A touch control apparatus according to a fourth embodiment of the present invention differs from the touch control apparatus according to the second embodiment, in that a correction curve is produced based on a touch data at a time of a user's usual play, although the touch control apparatus according to the second embodiment produces the correction curve in accordance with the mf touch data specially entered by the user. The structure different from the touch control apparatus according to the second embodiment is mainly described below.

The keyboard curve shown in FIG. 13 and the correction table shown in FIG. 14 are also used in the touch control apparatus according to this fourth embodiment. However, the correction curves A1, A2 in the correction table are produced by treating a standard curve ST in accordance with the difference between the pre-determined standard value and a velocity value obtained by converting a touch data produced by a user's usual play based on in accordance with the keyboard curve. The process for generating the correction curve will be described later in detail).

The configuration of the electronic instrument to which the touch control apparatus according to this fourth embodiment is applied is equal to that of the electronic instrument shown in FIG. 3, except the configuration of the operation panel. So, a configuration and an operation of the operation panel will be mainly described below.

Figure 25:
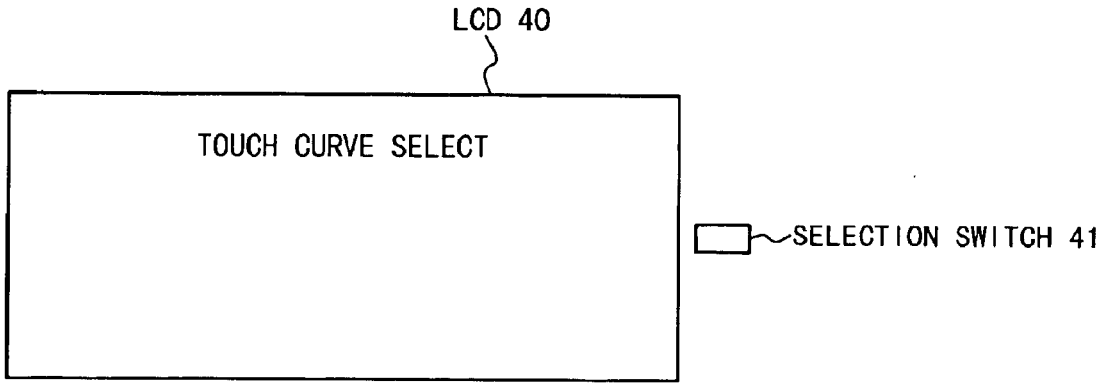
FIG. 25 is a view showing an example of an operation panel of an electronic instrument to which a touch control apparatus according to a fourth embodiment of the present invention is applied.

The operation panel 21 includes an LCD 40 and a selection switch 41, as shown in FIG. 25. The configurations and the functions of the LCD 40 and the selection switch 41 are identical to those of the second embodiment.

Next, the operation when the correction curve is produced in the electronic instrument having the above configuration will be described below.

At first, an operation mode of the electronic instrument is switched to a touch curve selection mode by using a mode setting function generally provided in the electronic instrument. In this condition, every time the selection switch 41 is pushed, the touch curve is circularly selected in the order such as "Normal"→"Light"→"Heavy"→"User"→"Normal"→ . . . The to correction curve selected when the selection switch 41 is stopped is employed for the play after that.

When "User" is selected by the selection switch 41, after that, it is always monitored whether or not there is a presence or absence of a hitting operation, namely, a generation of a touch data. Every time the touch data is generated, an average of the generated touch data and the previous touch data is calculated (hereafter, referred to as "average touch data").

When the number of hitting operations reaches a predetermined number of times, the correction curve is produced based on the average touch data. When the keyboard device 20 is operated under the condition that "User" is selected, the tone is generated based on the velocity value corrected in accordance with the produced correction curve. It should be noted that when "User" is selected at an initial state, since the correction curve is not still produced, the velocity value is produced by using the "Normal" touch curve.

Figure 26:
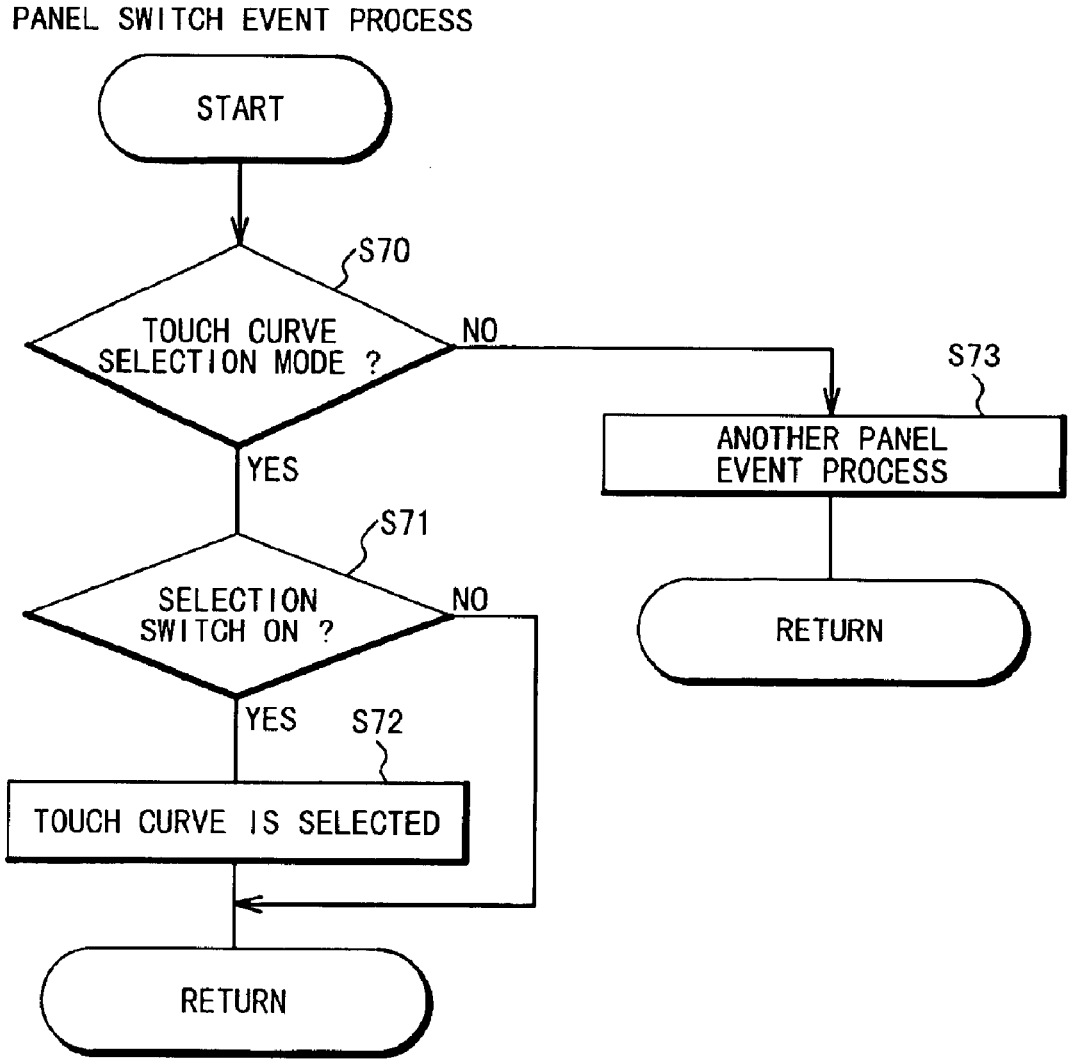
FIG. 26 is a flowchart detailing a panel switch event process of the electronic instrument to which the touch control apparatus according to the fourth embodiment of the present invention is applied.
Figure 27:
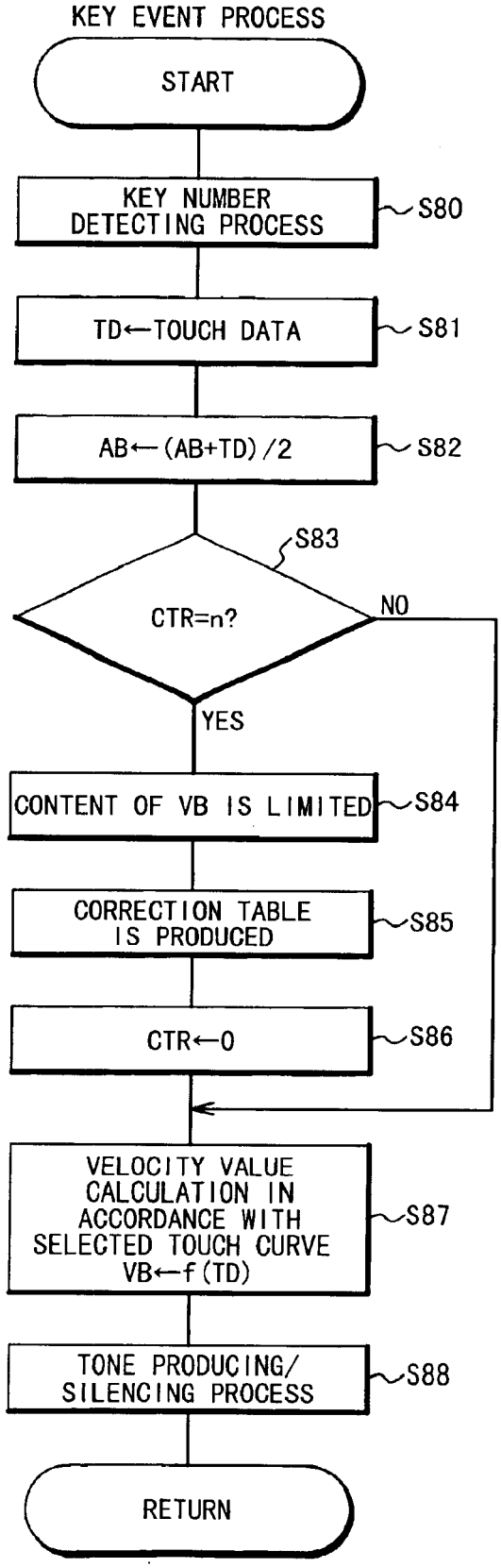
FIG. 27 is a flowchart detailing a key event process of the electronic instrument to which the touch control apparatus according to the fourth embodiment of the present invention is applied.

Next, the operation of the electronic instrument to which the touch control apparatus having the above configuration is applied will be described below with reference to flowcharts shown in FIGS. 26, 27.

(3-1) Main Process

The content of a main process is equal to that of the first embodiment, except the facts that in the initializing process (Step S10), a predetermined value is set for a content of an average buffer AB defined in the work memory 12 and that a hitting number counter CTR is cleared. As the predetermined value set for the average buffer AB, touch data of mezzo forte can be used.

(3-2) Panel Switch Event Process

The panel switch event process carried out at the step S12 in the main process routine will be described below with reference to the flowchart shown in FIG. 26. In this panel switch event process, it is firstly investigated whether or not the operation mode is set at a touch curve selection mode (Step S70). If it is judged that the operation mode is at the touch curve selection mode, it is investigated whether or not there is the on-event of the selection switch 41 (Step S71). If it is judged that there is the on-event event of the selection switch 41, the selection of the touch curve is carried out (Step S72). For example, if the selection switch 41 is pushed under the condition that the normal touch curve is selected, the light touch curve is selected. After that, the sequence returns back to the main process routine.

If it is judged at the step S71 that there is not the on-event of the selection switch 41, the sequence returns back to the main process routine. If it is judged at the step S70 that the operation mode is not set at the touch curve selection mode, another panel event process is carried out (Step S73). In this process, a process with regard to an event of another panel switch (not shown) is carried out. After that, the sequence returns back to the main process routine.

(3-3) Key Event Process

The key event process carried out at the step S14 in the main process routine will be described below in detail with reference to the flowchart shown in FIG. 27. In this key event process, a process for detecting a key number is firstly carried out (Step S80). In this process, a key number of a key corresponding to a bit that is set at "1" in the key event map is generated. Then, the touch data is captured from the key scanning circuit 13, and stored in the touch data buffer TD (Step S81).

Next, an average of the content of the average buffer AB and the content of the touch data buffer TD is calculated, and its result is stored in the average buffer AB (Step S82). By this process, an average of the touch data at the time of the user's usual play is calculated, and the calculated averaged value is stored in the average buffer AB. The content of the average buffer AB is used as the average touch data when the correction curve is produced.

Then, it is investigated whether or not a content of the hitting number counter CTR is "n" (Step S38). Here, "n" is an optional natural number. Timing to produce the correction curve is determined in accordance with the "n". If it is judged at the step S83 that the content of the hitting number counter CTR is "n"; the content of the average buffer AB is limited to a predetermined value (Step S84). For example, if the average touch data stored in the average buffer AB is smaller than "60", the content is limited to "60", and if it is greater than "100", the content is limited to "100", respectively. Accordingly, the average touch data is kept at the realistic value.

Then, the correction table is produced (Step S85). The process for producing the correction table is equal to the process at the step S49 in the second embodiment. Then, the content of the hitting number counter CTR is cleared to "0"(Step S86). If it is judged at the step S83 that the content of the hitting number counter CTR is not "n", the processes between the steps S84 to S86 are skipped.

Then, the velocity value is calculated in accordance with any of the touch curves T1 (Normal), T2 (Light) and T3 (Heavy) and the correction curve have been selected at that time (Step S87). That is, the velocity value corresponding to the captured touch data is read out from the correction table in the work memory 12 or the touch curve memory 110 in the program memory 11, and stored in the velocity buffer VB.

Then, the tone producing/silencing process is carried out (Step S88). That is, if a bit in a new key data corresponding to a bit that is set at "1" in the key event map is set at "1", the tone producing process is executed. If the bit in the new key data corresponding to the bit that is set at "1" in the key event map is set at "0", the tone silencing process is executed. In the tone producing process, a tone parameter is generated in accordance with the key number detected at the step S80 and the velocity value obtained at the step S87, and sent to the music tone generator 15. Thus, a tone having a height indicated by the key number and sound volume indicated on the basis of the velocity value is generated. It should be noted that the tone silencing process is carried out similarly to that of the first embodiment. After that, the sequence returns back to the main process routine.

The fourth embodiment may be designed such that the "n" compared with the content of the hitting number counter CTR can be entered as a numeral by using the numeral input device, such as a ten key, a dial, an up-down switch or the like, mounted on the operational panel. According to this configuration, the user can freely set the timing when the correction table is produced.

Also, the fourth embodiment is designed such that the correction curve is stored in the correction an table, and the new velocity value is obtained by referring to the correction table at the time of producing the tone. However, it may be designed such that the average touch data is saved beforehand, and when beforehand, the new velocity value is calculated based on the average touch data.

Also, it is designed such that the average touch data is obtained by actually operating the keyboard device. However, it may be designed such that the average touch data is entered as a numeral by using a numeral input device, such as a ten key, a dial, an up-down switch or the like, mounted on the operational panel.

Moreover, the fourth embodiment employs the velocity value when the key is hit with the mezzo forte as the standard value. However, the case when the key is hit with another strength is used as the standard value, similarly to the second embodiment.

As detailed above, the present invention can provide the touch control apparatus and the touch control method that can obtain the touch curve, from which the touch response suitable for the user can be obtained, easily and in a short time.

What is claimed is:

1. A touch control apparatus comprising:

a keyboard device which generates touch data indicative of strength of keying power;

a touch curve memory which stores a touch curve indicative of a correspondence relation of velocity and touch, data;

a corrector which corrects velocity values of said touch curve stored in said touch curve memory based on said touch data generated by said keyboard device to generate a new touch curve; and a mode switch which switches an operation mode of said touch control apparatus to a predetermined operation mode, wherein said corrector comprises:

a correction coefficient generator which generates a correction coefficient composed of a ratio of one of said velocity values corresponding to one of said touch data generated by said keyboard device under said predetermined operation mode to a maximum value of said velocity values, wherein the correction coefficient is variable in accordance with the strength of the keying power; and a touch curve generator which multiplies a plurality of said velocity values by said correction coefficient to shift the touch curve, thereby generating the new touch curve.

2. The touch control apparatus according to claim 1, wherein said correction coefficient generator generates said correction coefficient composed of the ratio of one of said velocity values corresponding to one of said touch data generated by said keyboard device pushed with a fortissimo strength of the keying power under said predetermined operation mode to a maximum value of said velocity values.

3. The touch control apparatus according to claim 2, further comprising:

a display device which displays the strength of the keying power when a key on said keyboard device is pushed.

4. The touch control apparatus according to claim 1, wherein the keyboard device comprises a key, a first sensor, and a second sensor, and wherein the strength of the keying power is determined using a time interval between detections by the first sensor and the second sensor, respectively, when the key is pushed.

5. The touch control apparatus according to claim 1, wherein the correction coefficient generator generates the correction coefficient responsive to a single one of said touch data generated by said keyboard device under said predetermined operation mode.

6. The touch control apparatus according to claim 1, wherein the correction coefficient is a ratio of maximum touch data indicative of a maximum strength of the keying power and the maximum value of said velocity values.

7. The touch control apparatus according to claim 6, wherein a user is prompted in the predetermined operation mode to push a key on the keyboard device with enough strength to generate the maximum touch data.

8. The touch control apparatus according to claim 1, wherein velocity values of the new touch curve that are greater than the maximum velocity value are replaced by the maximum velocity value.

9. The touch control apparatus of claims 1, wherein the correction coefficient generator generates another correction coefficient composed of a ratio of one of said velocity values corresponding to one of other touch data to the maximum value of said velocity values, and the touch curve generator multiplies the plurality of said velocity values by said another correction coefficient to shift the touch curve, thereby generating another new touch curve.

10. A touch control apparatus comprising:

a keyboard device which generates touch data indicative of strength of keying power;

a correction curve memory which stores a correction curve indicative of correction values to correct a keyboard curve indicative of a correspondence relation of velocity and touch data, said correction values corresponding to said touch data generated by said keyboard device;

corrector which corrects a plurality of the correction values stored in said correction curve memory based on said touch data generated by said keyboard device to shift the correction curve, thereby generating a new correction curve, wherein the correction values are variable in accordance with the strength of the keying power; and a mode switch which switches an operation mode of said touch control apparatus to a predetermined operation mode, wherein said corrector, when a correction value corresponding to said touch data generated by said keyboard device under said predetermined operation mode is different from a predetermined standard value, corrects said correction curve stored in said correction curve memory such that said correction value becomes the predetermined standard value.

11. The touch control apparatus according to claim 10, wherein said corrector, when said correction value corresponding to said touch data generated by said keyboard device pushed with a mezzo forte strength of the keying power under said predetermined operation mode is different from the predetermined standard value, corrects said correction curve stored in said correction curve memory such that said correction value becomes the predetermined standard value.

12. The touch control apparatus according to claim 11, further comprising:

a display device which displays the strength of the keying power when the key on said keyboard device is pushed.

13. The touch control apparatus according to claim 12, wherein said corrector includes:

an average calculator which calculates an average touch data by averaging said touch data generated by said keyboard device; and a curve corrector which when said correction value corresponding to said touch data generated by said keyboard device is different from the average touch data calculated by said average calculator, corrects said correction curve stored in said correction curve memory such that said correction value is replaced by said average touch data.

14. The touch control apparatus according to claim 13, further comprising:

a display device which displays the strength of the keying power when the key on said keyboard device is pushed.

15. A touch control method comprising:

generating touch data indicative of strength of keying power;

storing a touch curve indicative of a correspondence relation of velocity and touch data;

correcting velocity values of said touch curve based on said generated touch data to generate a new touch curve; and switching an operation mode to a predetermined operation mode, wherein said correcting velocity values comprises:

generating a correction coefficient composed of a ratio of one of said velocity values corresponding to one of said touch data generated in said touch curve generating step under said predetermined operation mode to a maximum value of said velocity values, wherein the correction coefficient is variable in accordance with the strength of the keying power; and multiplying a plurality of said velocity values by said correction coefficient to shift the touch curve, thereby generating the new touch curve.

16. The touch control method according to claim 15, wherein said correction coefficient generating step generates said correction coefficient composed of the ratio of one of said velocity values corresponding to one of said touch data generated based on a fortissimo strength of the keying power under said predetermined operation mode to a maximum value of said stored velocity values.

17. The touch control method according to claim 16, further comprising:

displaying the strength of the keying power when said touch data is generated.

18. A touch control method comprising:

generating touch data indicative of strength of keying power;

storing a correction curve indicative of correction values to correct a keyboard curve indicative of a correspondence relation of velocity and touch data, said correction values corresponding to said touch data generated in said touch data generating step;

correcting a plurality of said stored correction values based on said generated touch data to shift the correction curve, thereby generating a new correction curve, wherein the correction values are variable in accordance with the strength of the keying power; and switching an operation mode to a predetermined operation mode, wherein said correcting said stored correction values, when a correction value corresponding to said touch data generated under said predetermined operation mode is different from a predetermined standard value, corrects said stored correction curve such that said correction value becomes the predetermined standard value.

19. The touch control method according to claim 18, wherein said correcting said stored correction values, when said correction value corresponding to said touch data generated based on a mezzo forte strength of the keying power under said predetermined operation mode is different from the predetermined standard value, corrects said stored correction curve such that said correction value becomes the predetermined standard value.

20. The touch control method according to claim 19, further comprising:

displaying the strength of the keying power when said touch data is generated.

21. The touch control method according to claim 20, wherein said correcting said stored correction values comprises:

calculating an average touch data by averaging said touch data generated in said touch data generating step; and when said correction value corresponding to said touch data is different from the average touch data calculated in said average touch data calculating step, corrects said stored correction curve such that said correction value is replaced by said average touch data.

22. The touch control method according to claim 21, further comprising:

displaying the strength of the keying power when touch curve is generated.

23. A touch control apparatus comprising:

a keyboard device which generates touch data indicative of strength of keying power, said keyboard comprising a plurality of keys;

a correction curve memory which stores a correction curve indicative of correction values to correct a keyboard curve indicative of a correspondence relation of velocity and touch data, said correction values corresponding to said touch data generated by said keyboard device, wherein the correction curve is generated through pushing at least one of the plurality of keys using a single keying power; and a corrector which corrects a plurality of the correction values stored in said correction curve memory based on said touch data generated by said keyboard device to shift the correction curve, thereby generating a new correction curve, wherein the correction values are variable in accordance with strength of the single keying power.

* * * * *

UNITED STATES PATENT AND TRADEMARK OFFICE

CERTIFICATE OF CORRECTION

PATENT NO. : 6,906,695 B1
APPLICATION NO. : 09/724200
DATED : June 14, 2005
INVENTOR(S) : Ishida et al.

It is certified that error appears in the above-identified patent and that said Letters Patent is hereby corrected as shown below:

On the Title Page, item

| | |
|---|---|
| (30) Foreign Application Priority Data | Delete "11-335769",<br>Insert --1999-335769-- |
| Column 19, line 19, Claim 1 | delete "," |
| Column 20, line 7, Claim 9 | Delete "claims",<br>Insert --claim-- |
| Column 20, line 24, Claim 10 | Before "corrector",<br>Insert --a-- |
| Column 21, line 13, Claim 15 | Delete "comprises",<br>Insert --comprise-- |

Signed and Sealed this

Fifth Day of September, 2006

JON W. DUDAS
*Director of the United States Patent and Trademark Office*